US011154765B1

(12) United States Patent
Pantazelos et al.

(10) Patent No.: US 11,154,765 B1
(45) Date of Patent: Oct. 26, 2021

(54) SKI BINDING WITH PYROTECHNIC FASTENER RELEASE

(71) Applicant: Stop River Development LLC, Park City, UT (US)

(72) Inventors: George Pantazelos, Park City, UT (US); Joseph K. Lane, Branford, CT (US)

(73) Assignee: Stop River Development LLC, Park City, UT (US)

( * ) Notice: Subject to any disclaimer, the term of this patent is extended or adjusted under 35 U.S.C. 154(b) by 0 days.

(21) Appl. No.: 16/940,650

(22) Filed: Jul. 28, 2020

(51) Int. Cl.
*A63C 9/08* (2012.01)
*A63C 9/088* (2012.01)

(52) U.S. Cl.
CPC ..... *A63C 9/0802* (2013.01); *A63C 9/088* (2013.01)

(58) Field of Classification Search
CPC ..... A63C 9/08; A63C 9/0802; A63C 9/086; A63C 9/088; A63C 9/0885
See application file for complete search history.

(56) References Cited

U.S. PATENT DOCUMENTS 3,671,054 A * 6/1972 Mittelstadt ..... A63C 9/088 280/611
3,919,563 A * 11/1975 Lautier ..... A63C 9/088 307/119
4,121,854 A * 10/1978 Cornu ..... A63C 9/0802 280/612
4,291,894 A * 9/1981 D'Antonio ..... G01L 5/03 280/612
4,361,344 A * 11/1982 Hull ..... A63C 9/0802 280/613
4,371,188 A * 2/1983 Hull ..... A63C 9/0802 280/613
4,463,968 A * 8/1984 Hull ..... A63C 9/0802 280/612
4,494,767 A * 1/1985 Campillo ..... A63C 9/088 280/612

(Continued)

FOREIGN PATENT DOCUMENTS

EP 3210651 A1 8/2017

OTHER PUBLICATIONS

ISA, "International Search Report", PCT/US2020/043822, dated Oct. 19, 2020.

*Primary Examiner* — Jeffrey J Restifo
(74) *Attorney, Agent, or Firm* — Intrinsic Law Corp.

(57) ABSTRACT

A ski binding release system includes a spring that is releasably maintained in a first state using a pyrotechnic fastener. In the first state, a ski boot is secured in the ski binding. The pyrotechnic fastener is electrically coupled to an activation circuit. The activation circuit includes a battery, a plurality of sensors, a switch, and a controller. When the controller determines that the skier has fallen, the controller generates an output signal that transitions the switch from a disconnected state to a connected state. In the disconnected state, the pyrotechnic fastener is electrically disconnected from the battery. In the connected state, the pyrotechnic fastener is electrically connected to the battery. Electrical energy from the battery causes the pyrotechnical fastener to explode to transition the spring from the first state to a second state to release the ski boot from the ski binding.

26 Claims, 17 Drawing Sheets

(56) References Cited

U.S. PATENT DOCUMENTS

| | | | | | |
|---|---|---|---|---|---|
| 4,494,768 | A * | 1/1985 | Hull | A63C 9/0802 | 280/612 |
| 5,050,903 | A | 9/1991 | Stritzel et al. | | |
| 5,294,144 | A * | 3/1994 | Stepanek | A63C 9/0802 | 280/612 |
| 5,356,169 | A | 10/1994 | Hue et al. | | |
| 5,743,550 | A * | 4/1998 | Frohwein | A63C 9/0802 | 280/612 |
| 6,769,711 | B1 * | 8/2004 | Martin | A63C 9/0802 | 280/625 |
| 7,073,812 | B2 * | 7/2006 | Rigal | A63C 9/0802 | 280/611 |
| 7,841,614 | B2 * | 11/2010 | Damiani | A63C 9/088 | 280/611 |
| 8,403,354 | B2 * | 3/2013 | Senner | A63C 9/0885 | 280/623 |
| 9,526,971 | B1 * | 12/2016 | Barden | A63C 9/0802 | |
| 9,545,559 | B2 * | 1/2017 | Romashev | A63C 10/28 | |
| 9,597,567 | B1 * | 3/2017 | Tran | A63B 60/16 | |
| 2004/0145154 | A1 | 7/2004 | Holzer | | |
| 2007/0170695 | A1 | 7/2007 | Damiani et al. | | |
| 2013/0316317 | A1 | 11/2013 | Bilbao | | |
| 2019/0201776 | A1 | 7/2019 | Pantazelos et al. | | |
| 2019/0380426 | A1 | 12/2019 | Sun et al. | | |

* cited by examiner

SKI BINDING WITH PYROTECHNIC FASTENER RELEASE

TECHNICAL FIELD

This application is generally directed to ski bindings.

BACKGROUND

Various sports employ a sport boot coupled to another sporting platform (e.g., a ski or board) by way of a binding that controllably releases the boot or user's foot from the platform. The release of the user's foot or boot from the platform is for safety reasons (e.g., to avoid excessive forces or twist of a user's foot) in case of an accident. In most current systems the release occurs when a mechanical threshold, e.g., a force exceeds a preset limit. The binding then mechanically decouples the user's foot or boot to set the platform (ski, board) free.

These conventional bindings are of limited use in protecting from very rapid events such as those experienced in competition sports like downhill skiing. Injuries to users include bone fractures, spinal injuries, concussions and other head injuries. More particularly in winter mountain sports, anterior cruciate ligament (ACL) injuries are far too common. Conventional bindings are manually adjusted based on anecdotal experience or approximate metrics, have finite (mechanical) response times, and do not sufficiently or effectively respond to prevent or reduce ACL or other injuries. Attempts to modernize bindings and binding release systems have not resulted in effective or commercially viable alternatives to current systems.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

An embodiment is directed to a apparatus comprising a ski binding including a spring that has a first state that secures a ski boot in the ski binding and a second state that releases the ski boot from the ski binding; an explosive bolt in mechanical communication with the spring to releasably maintain the spring in the first state; a battery; an activation circuit extending from the explosive bolt to the battery, the activation circuit including a switch having a connected state in which the battery and the explosive bolt are electrically connected through the switch and a disconnected state in which the battery and the explosive bolt are electrically disconnected; and a processor-based controller electrically coupled to the switch, the processor configured to automatically generate an output signal that transitions the switch from the disconnected state to the connected state to activate the explosive bolt in response to an input signal from one or more sensors, wherein activation of the explosive bolt causes the spring to transition from the first state to the second state to thereby release the ski boot from the ski binding.

An embodiment is directed to an automated method for releasing a ski boot from a ski binding, comprising receiving, by a processor-based controller, sensor data from a plurality of sensors disposed on a skier, on the ski boot, and/or on the ski binding; in the processor-based controller, evaluating the sensor data to determine a state of the skier; when the processor-based controller determines that the skier is in a falling state, automatically generating an output signal, with the processor-based controller, to activate a pyrotechnic fastener in the ski binding, the pyrotechnic fastener maintaining a spring, in the ski binding, in a first state that secures the ski boot in the ski binding; generating an explosion with the pyrotechnic fastener, the explosion breaking at least a portion of the pyrotechnic fastener; and transitioning the spring from the first state to a second state that releases the ski boot from the ski binding.

An embodiment is directed to an automated method for releasing a ski boot from a ski binding, comprising wirelessly receiving, by a processor-based controller, a manual activation signal from a manual release device; automatically generating an output signal, with the processor-based controller in response to the manual activation signal, to activate a pyrotechnic fastener in the ski binding, the pyrotechnic fastener maintaining a spring, in the ski binding, in a first state that secures the ski boot in the ski binding; generating an explosion with the pyrotechnic fastener, the explosion breaking at least a portion of the pyrotechnic fastener; and transitioning the spring from the first state to a second state that releases the ski boot from the ski binding.

BRIEF DESCRIPTION OF THE DRAWINGS

For a fuller understanding of the nature and advantages of the present concepts, reference is made to the detailed description of preferred embodiments and the accompanying drawings.

DETAILED DESCRIPTION

A pyrotechnic fastener is used to releasably secure a spring in a ski binding. The pyrotechnic fastener maintains the spring in a first state to secure a ski boot in the ski binding. When the pyrotechnic fastener is activated, the pyrotechnic fastener explodes and breaks (or at least a portion of the pyrotechnic fastener breaks). Breaking the pyrotechnic fastener causes the spring to transition from the first state to a second state where the ski boot is released (or at least partially released) from the ski binding.

The pyrotechnic fastener can include an explosive bolt (or an explosive screw) and/or a frangible nut (an explosive nut). The pyrotechnic fastener includes a cavity to hold explosive material. For example, the explosive bolt can include a hollow cylinder or another cavity to hold the explosive material. Likewise, the frangible nut can include a segment or other portion that includes a cavity to hold the explosive material.

An igniter is disposed proximal to the explosive material, such as next to, on top of, or within the explosive material. The igniter is electrically coupled to an activation circuit that outputs electrical current or power upon detection that the skier is in a falling state. The electrical current or power causes the igniter to ignite the explosive material (e.g., via a spark, temperature increase, etc.), which causes an explosion that at least partially breaks the pyrotechnic fastener, thereby causing the spring to transition from the first state to the second state. In some embodiments, the spring has a higher tension in the first state than in the second state. Thus, the spring can naturally return to the lower-tension second state when the pyrotechnic fastener is detonated.

The activation circuit includes a battery, a switch, a controller, and a plurality of sensors. The sensors are disposed on the skier, on the ski binding, and/or on the boot(s). Data from the sensors is evaluated by the controller to determine when the skier begins to fall (e.g., is in a falling state). When the controller determines that the skier has started to fall, the controller generates an output signal that causes the switch to transition from a disconnected state to a connected state. In the disconnected state, the battery is electrically disconnected (or electrically decoupled) from the pyrotechnic fastener. In the connected state, the battery is electrically connected (or electrically coupled) to the pyrotechnic fastener. Electrical energy from the battery causes the pyrotechnic fastener to ignite and explode, thereby releasing the ski boot from the ski binding.

Figure 1:
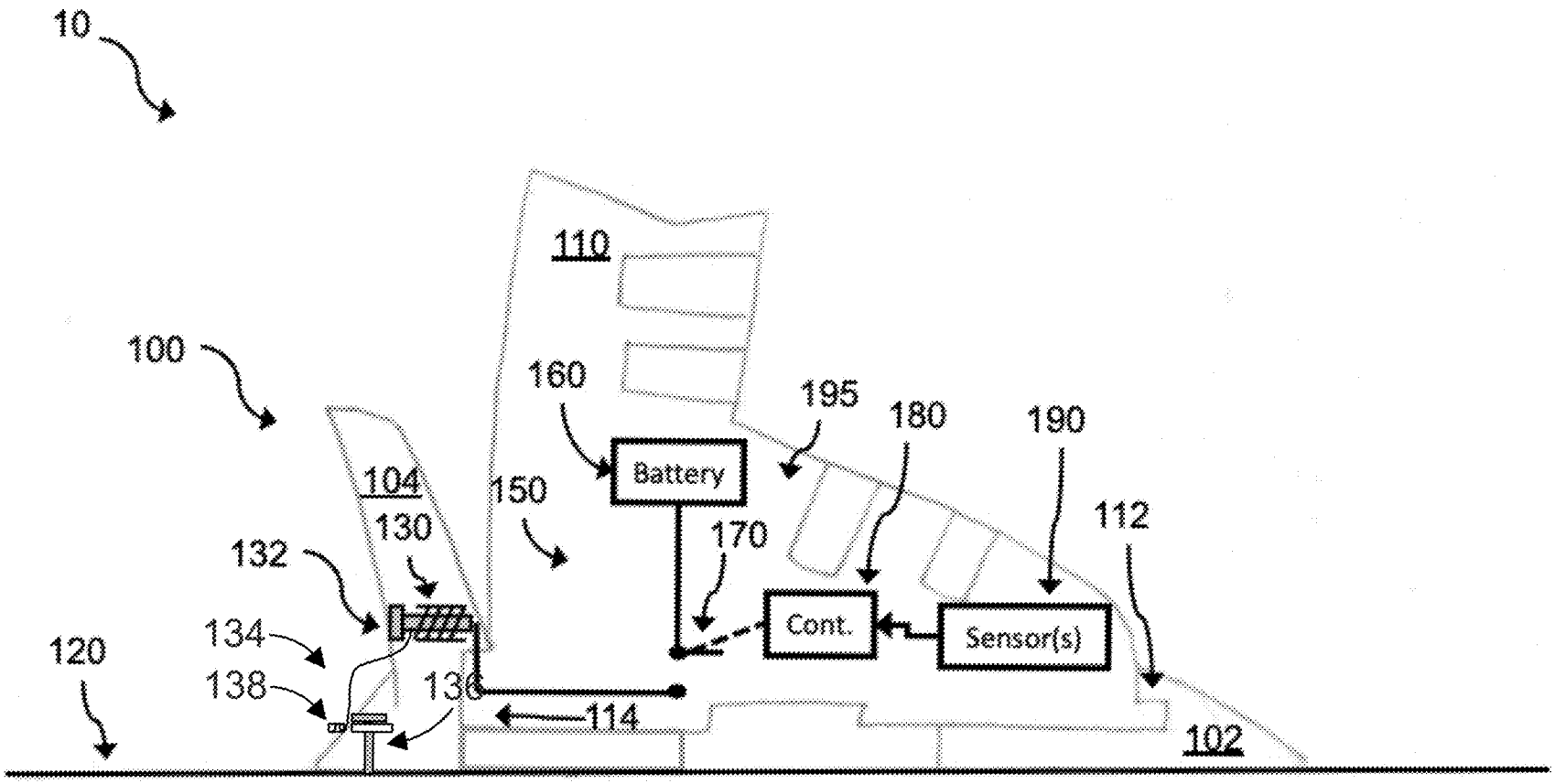
FIG. 1 is a side view of an automated pyrotechnic ski binding release system in a disconnected state according to an embodiment.

FIG. 1 is a side view of an automated pyrotechnic ski binding release system 10 according to an embodiment. The system 10 includes a ski binding 100, a boot 110, and a ski 120. The ski binding 100 is attached to the ski 120, such as by screws, bolts, or other attachment mechanisms. The boot 110 is releasably mechanically attached to the ski binding 100 (e.g., a ski binding assembly). For example, a toe lip 112 of the boot 110 is releasably mechanically attached to a toe piece 102 of the ski binding 100. In addition, a heel lip 114 of the boot 110 is releasably mechanically attached to a heel piece 104 of the ski binding 100. Together, the toe piece 102 and the heel piece 104 of the ski binding 100 comprise mechanical engagement points that releasably secure the boot 110 onto the ski 120.

The ski binding 100 includes one or more springs 130 that apply pressure and/or provide resistance to the boot 110 when the boot 110 is releasably mechanically attached to the ski binding 100. Examples of the springs 130 in the heel piece 104 of the ski binding 100 include a forward pressure spring and a heel DIN spring. An example of the spring 130 in the toe piece 102 of the ski binding 100 is a toe DIN spring.

The tension of the springs 130 can be adjusted by turning a bolt or screw (in general, bolt). One or more of the bolts is an explosive bolt 132 that can release the tension on the respective spring 130 when the explosive bolt 132 is activated or detonated. Releasing the tension on one or more springs 130 causes the boot 110 to release from the ski binding 100.

The explosive bolt(s) (in general, explosive bolt) 132 is electrically coupled to an electrical circuit 150 that can provide power to ignite, activate, and/or explode an explosive material in the explosive bolt 132. In one example, the power from the electrical circuit 150 initiates or triggers an exothermic chemical reaction in the explosive material. The explosive material can include gunpowder (black powder), hexanitrostilbene, and/or another explosive material.

Figure 2:
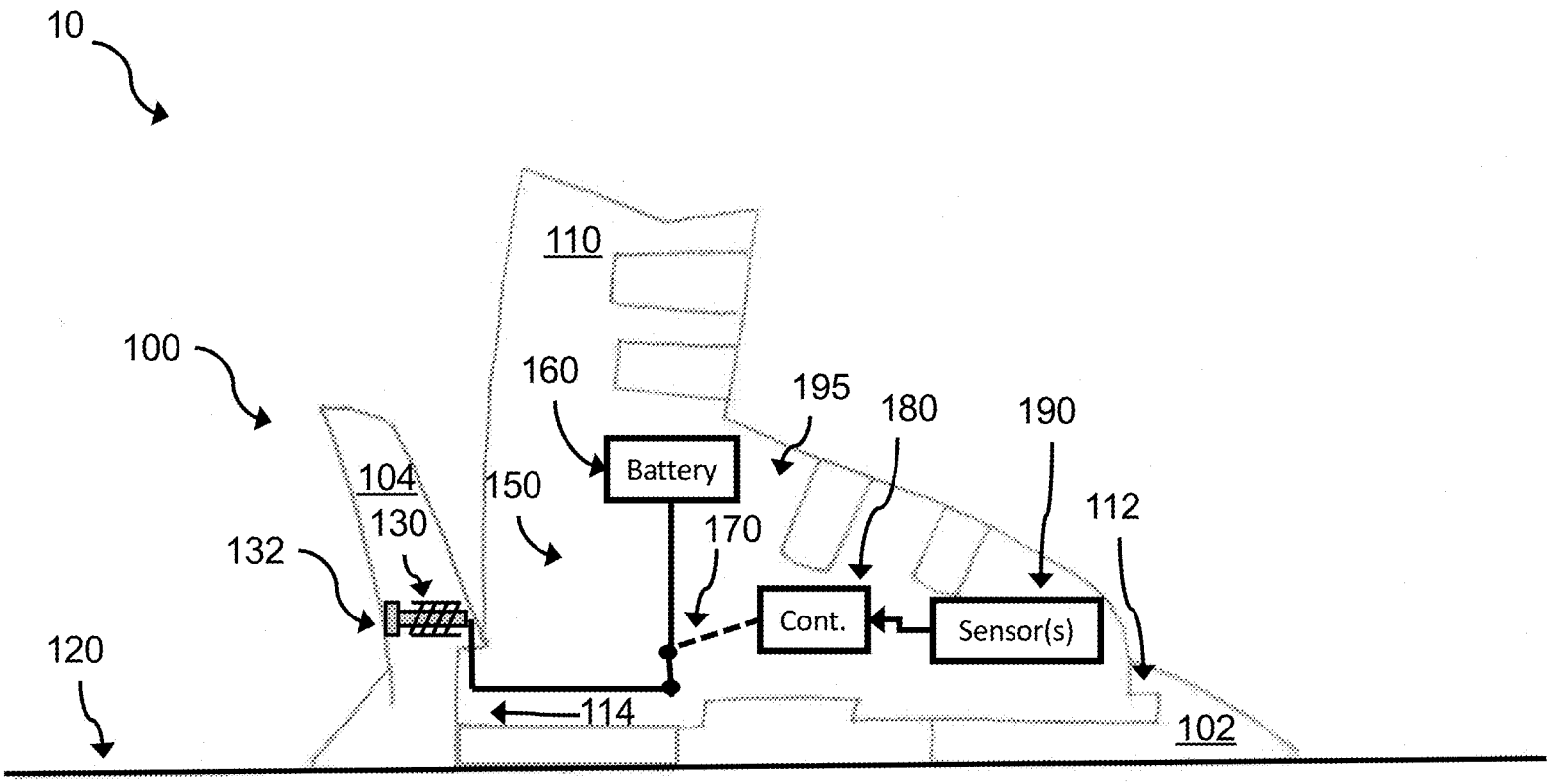
FIG. 2 is a side view of the automated pyrotechnic ski binding release system of FIG. 1 in a connected state.

The power to activate the explosive bolt 132 can be provided by a battery 160 or another energy-storage device. In a specific example, the battery 160 can be a 12V or a 9V battery. The electrical circuit 150 includes a switch 170 having a connected state and a disconnected state. In FIG. 1, the switch 170 is in the disconnected state such that the explosive bolt 132 is electrically disconnected from the battery 160. In FIG. 2, the switch 170 is in the connected state such that the explosive bolt 132 is electrically connected to the battery 160.

The state of the switch 170 is controllable through an output signal generated by a microprocessor-based controller 180. The controller 180 can generate the output signal based on input signals from one or more sensors 190. The input signals from the sensor(s) 190 can indicate whether the user (e.g., skier) has fallen (e.g., in a fallen state) and thus whether to change (e.g., automatically change) the state of the switch 570 to detonate the explosive bolt 132 to detach the boot 110 from the binding 100. The electrical circuit 150, battery 160, switch 170, controller 180, and the sensor(s) 190 can be referred to as an activation circuit 195.

Though the activation circuit 195 is illustrated in FIG. 1 as being disposed on the boot 110, it is noted that any of the activation circuit 195 components (e.g., the electrical circuit 150 (or a portion thereof), battery 160, switch 170, controller 180, and/or the sensor(s) 190) can be disposed in another location, such as on the user's body, on the binding 100, and/or on the skis 120. In one example, the controller 180 and/or the sensor(s) 190 can comprise components of a smartphone or other electronic device held by or disposed on the user (e.g., in the user's pocket). In an example, a smart watch or similar wrist or arm-worn device having a user interface, optionally coupled to a mobile communication device or capable of its own wireless communication, is employed to achieve this purpose.

When the ski binding 100 includes multiple explosive bolts 132, the same activation circuit can be used to detonate some or all of the explosive bolts 132. In one example, the same activation circuit can be used to detonate the explosive bolts 132 in the heel piece 104 of the ski binding 100 while a different activation circuit can be used to detonate the explosive bolt(s) 132 in the toe piece 102 of the ski binding 100. In another embodiment, the same activation circuit can be used to detonate all the explosive bolts 132 in the ski binding 100 (e.g., in the toe piece 102 and in the heel piece 104). In an alternative embodiment, a different activation circuit can be used to detonate each explosive bolt 132. For example, there can be three separate or independent activation circuits when the ski binding 100 includes three explosive bolts 132.

In some embodiments, the activation circuit 195 can be activated manually in addition to automatically (e.g., based on sensor data). For example, the skier can press a manual activation button that is electrically coupled (e.g., via a wired or wireless connection) to the controller 180 to manually detonate the explosive bolt(s) 132.

A tether 134 can securely attach each explosive bolt 132 to the ski binding 100 to prevent the explosive bolt 132 from turning into a projectile that could injure a nearby skier or spectator and from littering the ski slope. The tether 134 can comprise a wire, cable, cord, lanyard, or other tether. The tether 134 can be tied around the explosive bolt 132, can pass through a hole in the explosive bolt 132, and/or be attached to a washer that itself is attached to the explosive bolt 132. In addition, the tether 134 is attached to another bolt or screw in the ski binding 100. For example, the tether 134 can be attached to a bolt 136 that attaches the ski binding 100 to the ski 120. The bolt 136 can have a hole through which the tether 134 can pass to attach to the bolt 136. In another example, the tether 134 can be attached to a washer 138 for the bolt 136. The washer 138 can have a hole through which the tether 134 can pass to attach to the washer 138 such as by winding, soldering, welding, or other attachment technique.

When the ski binding 100 includes multiple explosive bolts 132, some or all of the explosive bolts 132 can be attached to a respective tether 134. A tether, such as tether 134, can be used with any of the explosive bolts and frangible nuts disclosed herein.

Figure 3:
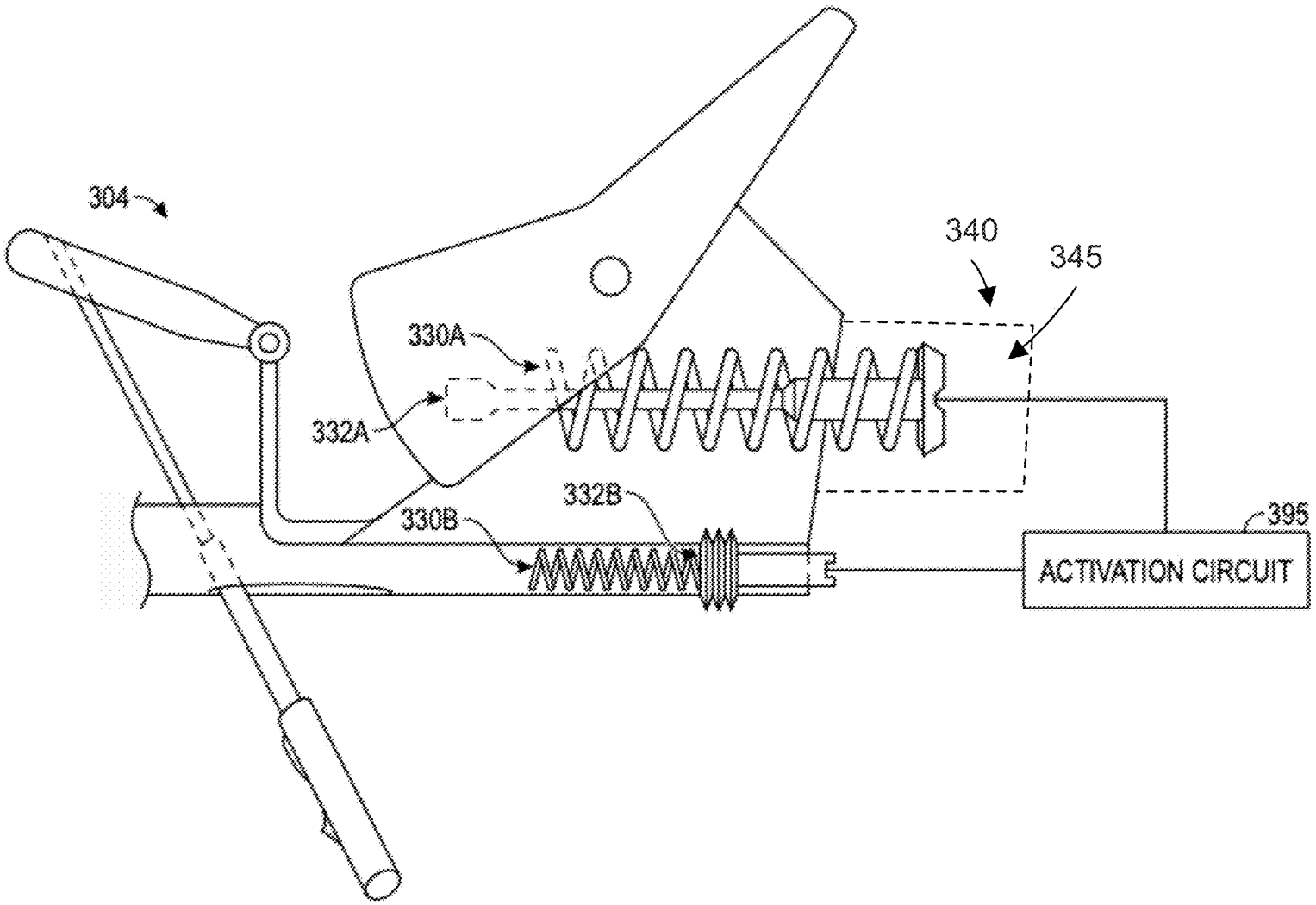
FIG. 3 is a side view of a heel piece of a ski binding according to an embodiment.

FIG. 3 is a side view of a heel piece 304 of a ski binding according to an embodiment. The heel piece 304 can be the same as heel piece 104. As illustrated, the heel piece 304 includes 2 springs 330A, 330B. The first spring 330A can correspond to a heel DIN spring. The second spring 330B can correspond to a forward-pressure spring. The tension of each spring 330A, 330B is set according to the relative position of a respective explosive bolt 332A, 332B. Each explosive bolt 332A, 332B can be the same as explosive bolt 132. In an alternative embodiment, only one of the bolts 332A, 332B is an explosive bolt and the other is a standard (non-exploding) bolt.

In addition, FIG. 3 illustrates a bolt-retention housing 340 that covers explosive bolt 332A. The bolt-retention housing 340 includes a cavity 345 that retains or traps the explosive bolt 332A and spring 330A when the explosive bolt 332A is activated, such as to prevent injury to nearby skiers or spectators and to prevent littering on the ski slope. The surfaces of the bolt-retention housing 340 can be solid or they can have small holes, which can be used to allow air to circulate in the cavity 345 to provide oxygen for the ignition of the explosive material in the explosive bolt 332A. A bolt-retention housing, such as bolt-retention housing 340, can be used with any of the explosive bolts and frangible nuts disclosed herein.

Figure 4:
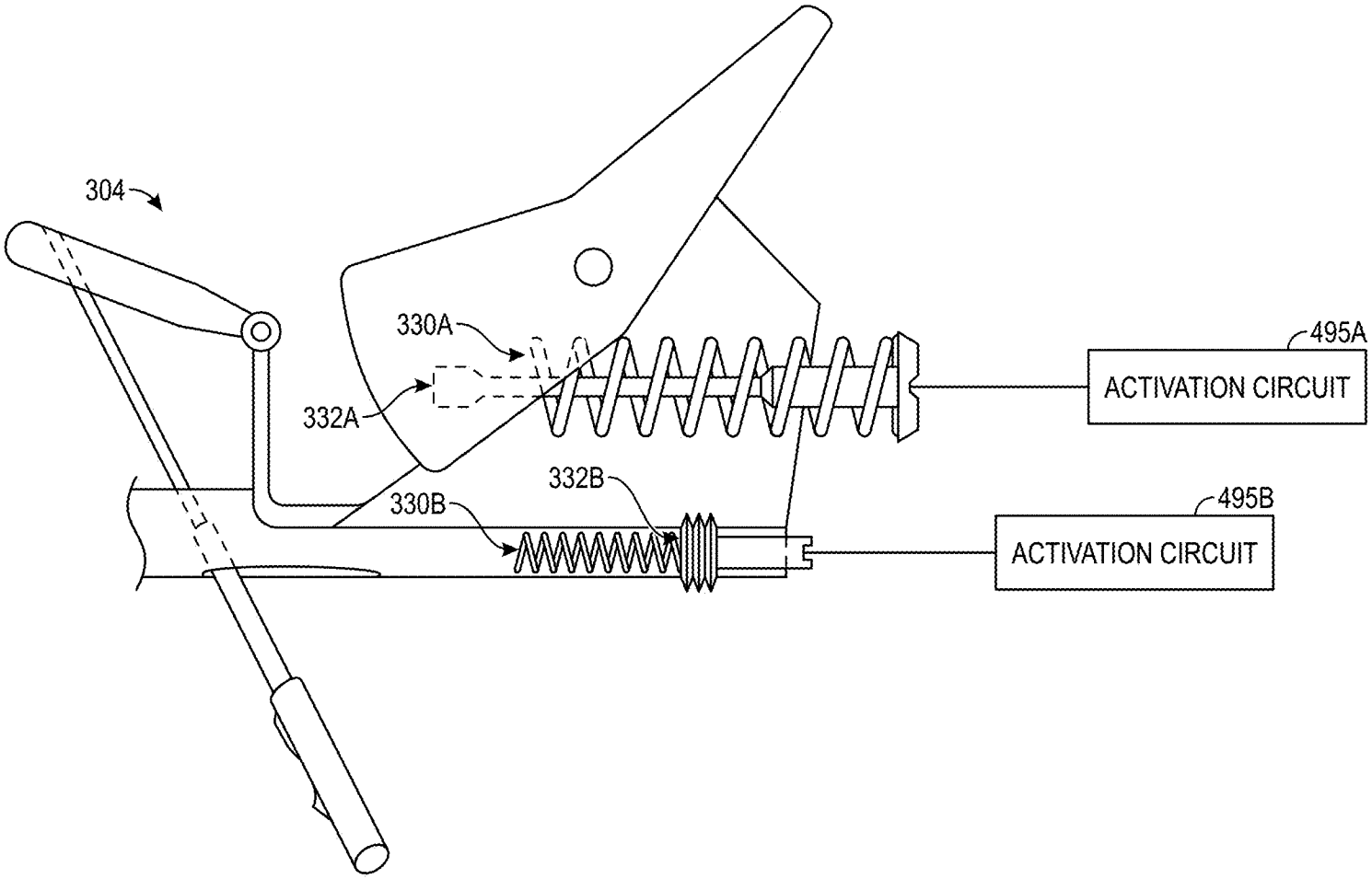
FIG. 4 illustrates an alternative embodiment of the heel piece illustrated in FIG. 3.

In addition, FIG. 3 illustrates an embodiment where both explosive bolts 332A, 332B are electrically coupled to the same activation circuit 395, which can the same as or different than activation circuit 195. In this embodiment, both explosive bolts 332A, 332B receive power from the same battery 160 to detonate simultaneously (or nearly simultaneously) when the switch 170 is in the connected state. In contrast, FIG. 4 illustrates where each explosive bolt 332A, 332B is electrically coupled to a respective activation circuit 495A, 495B. Each activation circuit 495A, 495B can be the same as activation circuit 195 or 395. It is noted that each activation circuit 495A, 495B can have its own sensors or the activation circuits 495A, 495B can have common sensors. As discussed above, the activation circuits (e.g., activation circuits 195, 395, 495A, 495B) can be located, at least partially, on the binding (e.g., toe piece and/or heel piece 304), on the boot(s), on the ski(s), and/or on the user's body.

Figure 5:
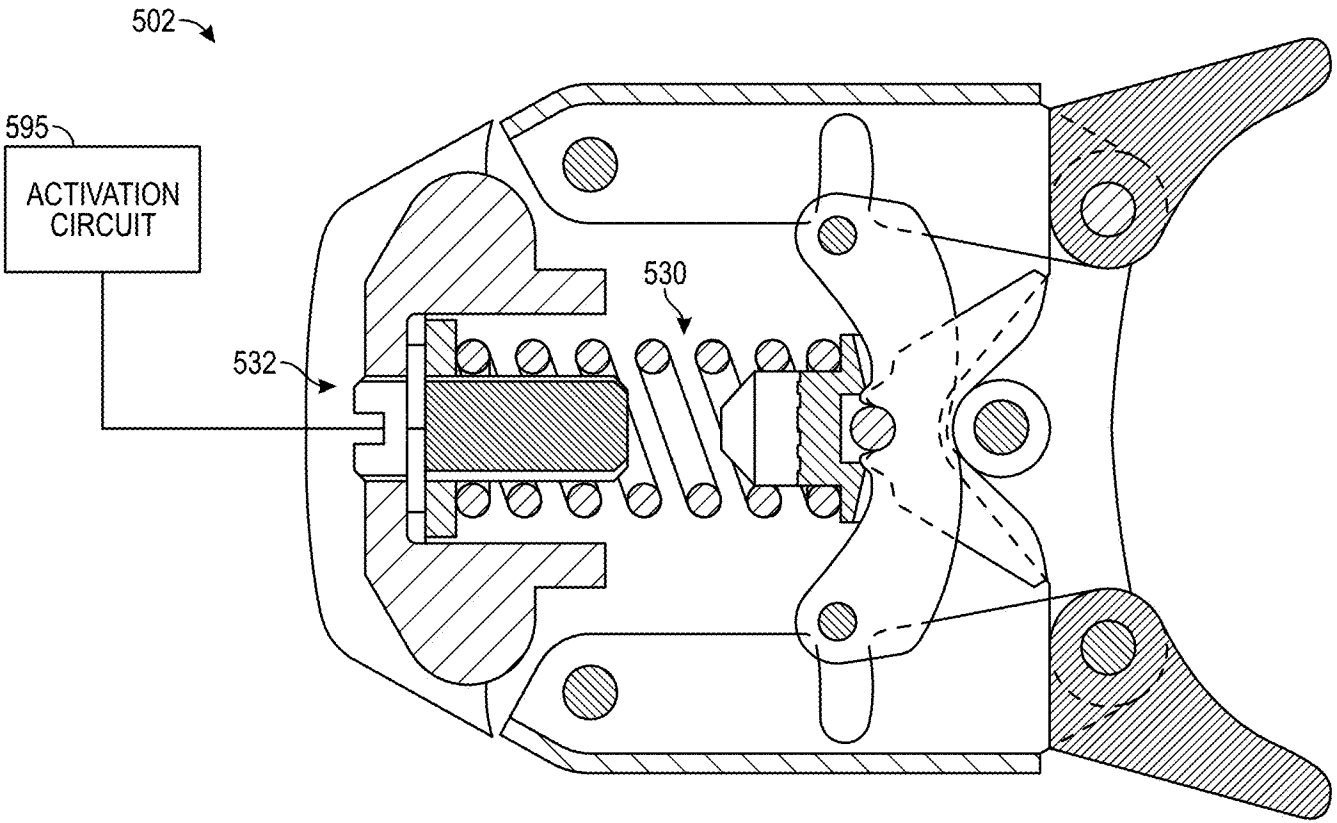
FIG. 5 is a top view of a toe piece of a ski binding according to an embodiment.

FIG. 5 is a top view of a toe piece 502 of a ski binding according to an embodiment. The toe piece 502 can be the same as toe piece 102. As illustrated, the toe piece 502 includes a toe spring 530 which can be a toe DIN spring. The tension of the toe spring 530 is set according to the relative position of an explosive bolt 532 which can be the same as explosive bolt 132. The explosive bolt 532 is electrically coupled to an activation circuit 595, which can be the same as activation circuit 195, 395, 495A, or 495B. The activation circuit 595 provides electrical energy, in response to data from sensors in the activation circuit that indicate that the user is falling or in a falling state, to detonate the explosive bolt 532. Detonating the explosive bolt 532 releases tension on the toe spring 530 which causes the ski binding to release the ski boot. The activation circuit 595 can be located, at least partially, on the binding (e.g., toe piece 502 and/or heel piece), on the boot(s), on the ski(s), and/or on the user's body.

In some embodiments, the ski binding includes both the toe piece 502 and the heel piece 304. In other embodiments, the ski binding includes only the toe piece 502 and a conventional heel piece (without any explosive bolts). In yet other embodiments, the ski binding includes a conventional toe piece (without any explosive bolts) and heel piece 304.

In an alternative embodiment, a frangible nut (an exploding nut) can be used in addition to or instead of an explosive bolt. For example, in some embodiments, the ski binding can a spring that is retained between an explosive bolt and a frangible nut. The use of two types of pyrotechnic fasteners can provide redundancy in case either one fails. In another embodiment, the ski binding can include a spring that is retained between a conventional (non-exploding) bolt and a frangible nut. Detonation of the frangible nut causes the spring to release tension to release the boot from the ski binding.

Figure 6:
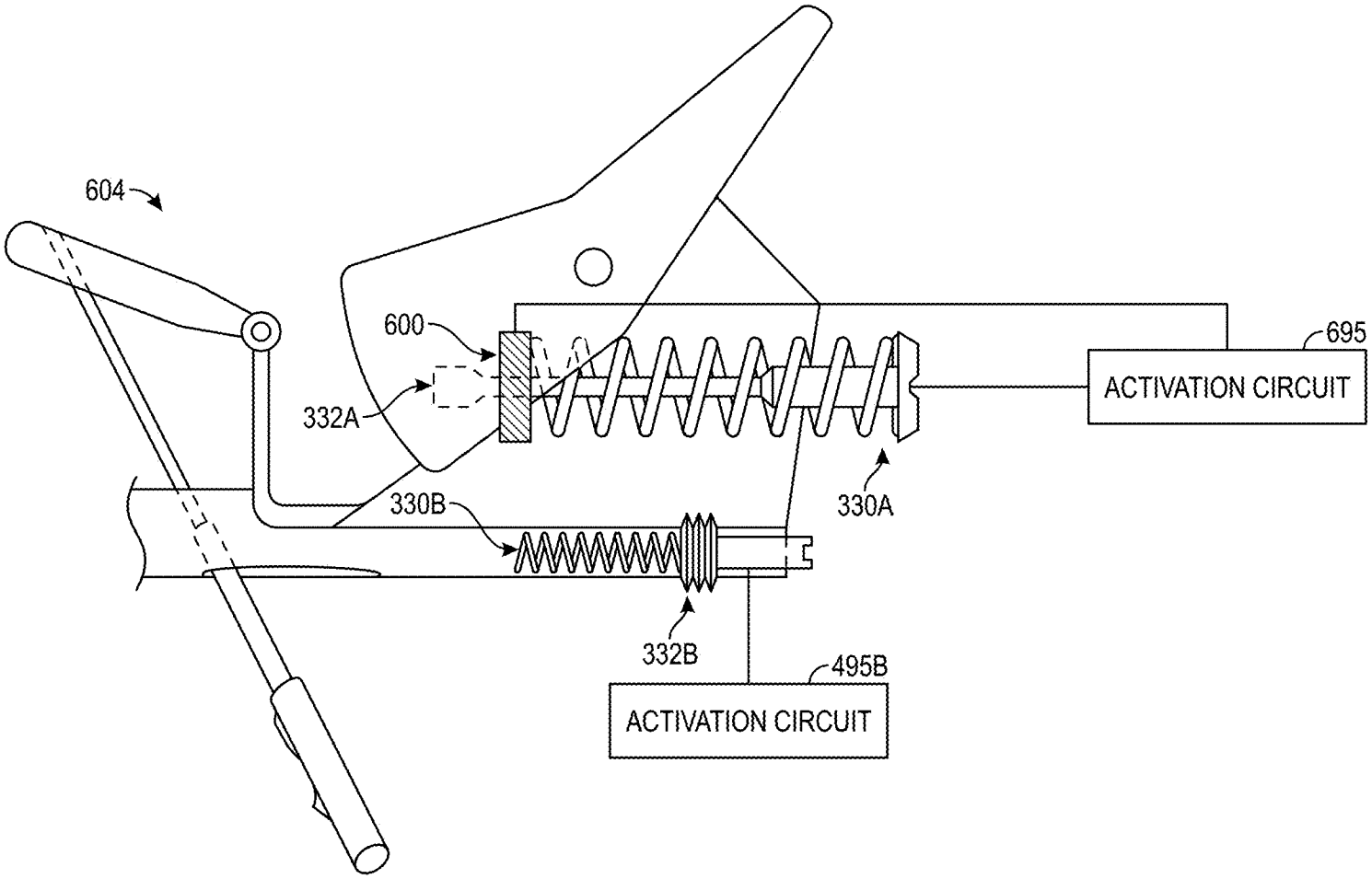
FIG. 6 is a side view of a heel piece of a ski binding according to another embodiment.

FIG. 6 is a side view of a heel piece 604 of a ski binding according to another embodiment. Heel piece 604 is the same as heel piece 304 expect that heel piece 604 includes a frangible nut 600 attached to a bolt 632A to provide tension to spring 330A. The bolt 632A can be an explosive bolt or a conventional non-explosive bolt. When the bolt 632A is an explosive bolt, the frangible nut 600 and the explosive bolt 632A can be electrically coupled to the same activation circuit 695, which can be the same as activation circuit 195. Alternatively, the frangible nut 600 and explosive bolt 632A can be coupled to separate activation circuits.

In some embodiments, the frangible nut 600, the optional explosive bolt 632A, and the explosive bolt 330B can be electrically coupled to the same activation circuit.

Figure 7:
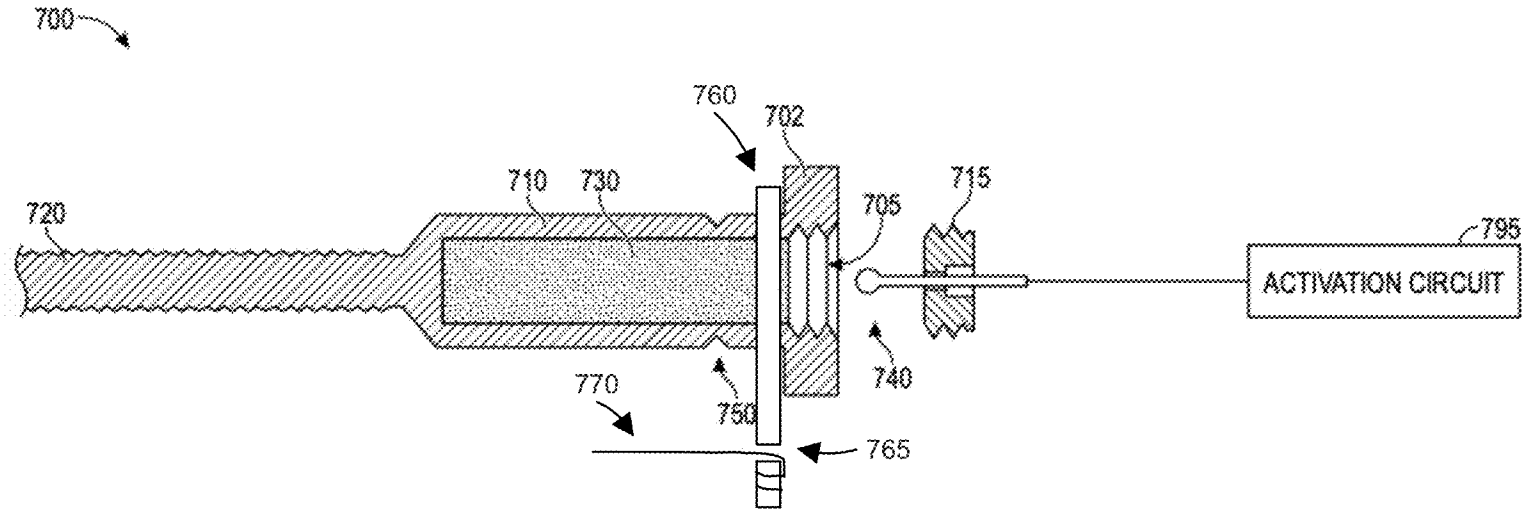
FIG. 7 is an exploded cross-sectional view of an explosive bolt according to an embodiment.

FIG. 7 is an exploded cross-sectional view of an explosive bolt 700 according to an embodiment. Explosive bolt 700 can be the same as or different than explosive bolt 132, explosive bolt 332A, explosive bolt 332B, and/or explosive bolt 532. Explosive bolt 700 includes a hollow cylinder 710 or other cavity and a threaded shaft 720. The hollow cylinder 710 is disposed between a head 702 of the explosive bolt 700 and the threaded shaft 720. An explosive material 730 is disposed in the hollow cylinder 710. The explosive material 730 can include black powder (gun powder), hexanitrostilbene, and/or another explosive material.

The head 702 of the explosive bolt 700 includes a threaded hole 705 to receive an igniter 740. The igniter 740 is inserted through the hole 705 and placed on or in (e.g., in direct physical contact with) the explosive material 730. A set screw 715 can be inserted into the hole 705 to maintain the position of the igniter 740 relative to the explosive material 730.

The igniter 740 is electrically coupled to an activation circuit 795, which can be the same as or different than any of the activation circuits described herein (e.g., activation circuit 195, 395, 495A, 495B, 595, and/or 695). The activation circuit 795 outputs electrical power (e.g., in response to sensor data that indicates that the skier is in a falling condition) to the igniter 740 which generates a spark and/or a rapid temperature increase to ignite and detonate/explode the explosive material 730. When the explosive material 730 detonates or explodes, at least a portion of the explosive bolt 700 (e.g., at least a portion of the hollow cylinder 710) breaks, causing the explosive bolt 700 to lose structural integrity and structurally fail, thereby releasing tension on the spring in the ski binding to release the ski boot. In some embodiments, the hollow cylinder 710 is scored 750 to promote breaking. The scored 750 region of the hollow cylinder 710 has a smaller cross-sectional wall thickness than the other portions of the hollow cylinder 710. Though only one scored 750 region is illustrated in FIG. 7, in other embodiments, there can be multiple scored regions.

In some embodiments, a washer 760 can be attached to the explosive bolt 700. The washer 760 includes a body having a hole 765 defined therein. A tether 770 is disposed through the hole 765 and secured to the washer 760 body such as by winding, soldering, welding, or other attachment technique. The tether 770 can also be attached to the ski binding 100 to prevent the explosive bolt 700 from injuring another person or from being ejected onto the ski slope when the explosive bolt 700 is activated or ignited.

Figure 8:
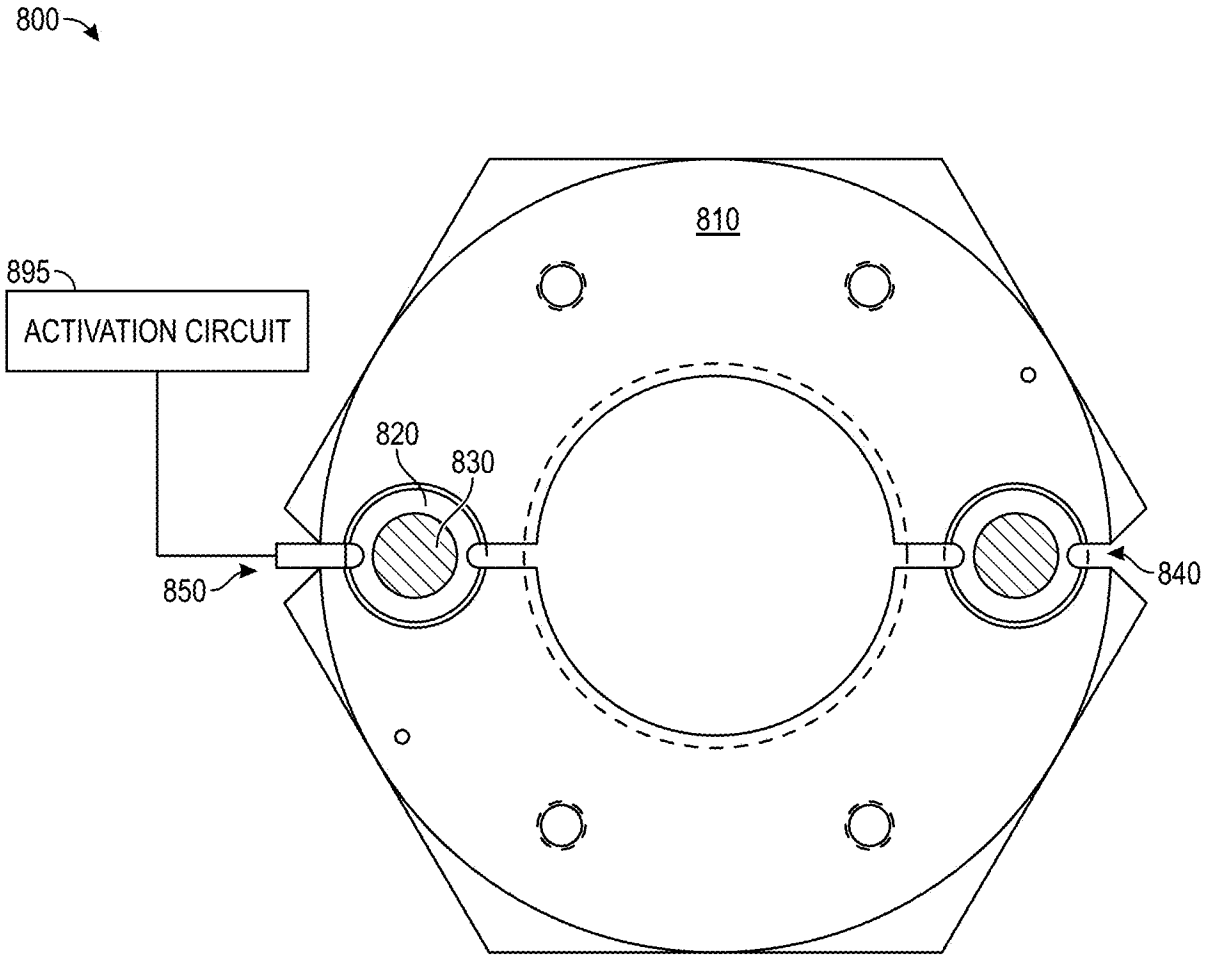
FIG. 8 is a cross-sectional view of a frangible nut according to an embodiment.

FIG. 8 is a cross-sectional view of a frangible nut 800 according to an embodiment. Frangible nut 800 can be the same as or different than frangible nut 600. Frangible nut 800 includes a toroidal body 810 that has a hollow region 820. An explosive material 830 is disposed in the hollow region 820. The explosive material 830 can include black powder (gun powder), hexanitrostilbene, and/or another explosive material.

The head body includes an aperture 840 to receive an igniter 850. The igniter 850 is inserted through the aperture 840 and placed on or in (e.g., in direct physical contact with) the explosive material 830. The igniter 840 is electrically coupled to an activation circuit 895, which can be the same as or different than any of the activation circuits described herein (e.g., activation circuit 195, 395, 495A, 495B, 595, 695, and/or 795).

The activation circuit 895 outputs electrical power (e.g., in response to sensor data that indicates that the skier is in a falling condition) to the igniter 850 which generates a spark and/or a rapid temperature increase to ignite and detonate/explode the explosive material 830. When the explosive material 830 detonates or explodes, at least a portion of the frangible nut 800 (e.g., at least a portion of the body 810) breaks, causing the explosive bolt 800 to lose structural integrity and structurally fail, thereby releasing tension on the spring in the ski binding to release the ski boot. In some embodiments, the cross-sectional thickness of the body 810 adjacent to the hollow region 820 is narrowed or removed to promote breaking.

Figure 9:
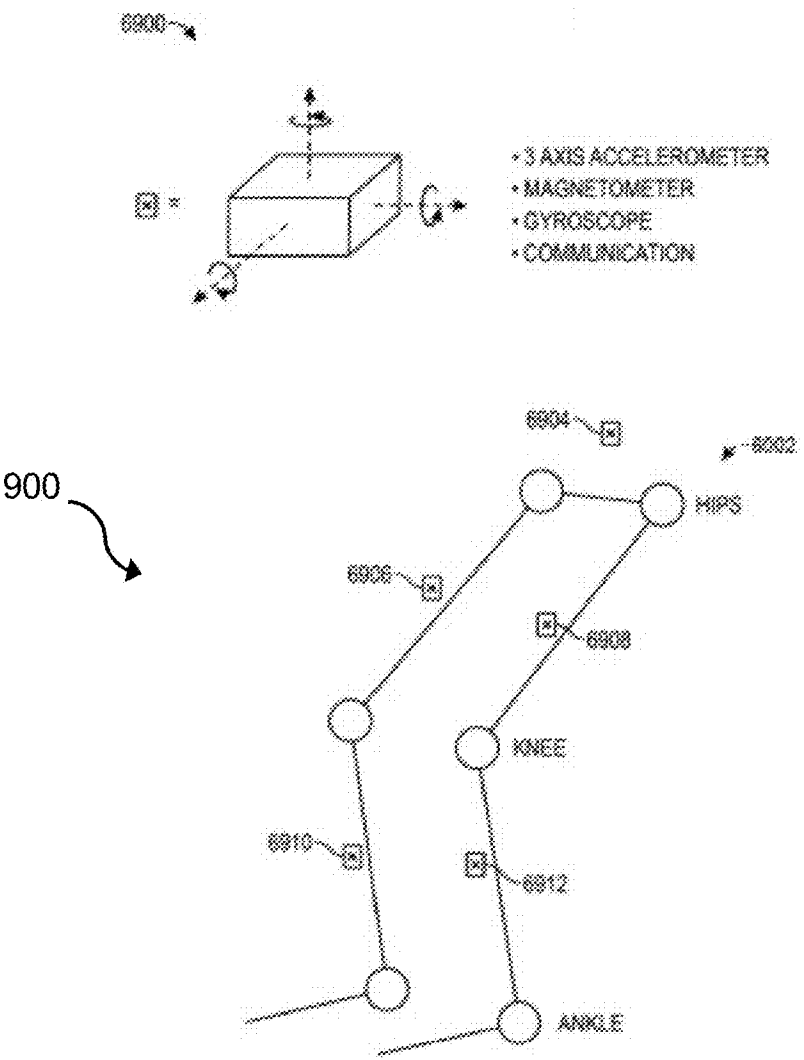
FIG. 9 is a schematic representation of one embodiment of a sensor system.

FIG. 9 is a schematic representation of one embodiment of a sensor system 900. The sensor system 900 can be the same as or different than the sensor(s) 190 described above. Thus, the sensor system 900 can be included in any of the activation circuits described herein (e.g., activation circuit 195, 395, 495A, 495B, 595, 695, 795, and/or 895).

The sensor system 900 can include a plurality of inertial (or other type of) sensors 6900 positioned on a skier 6902. The plurality of sensors 6900 may include a sensor 6904 positioned on a hip of the skier, a sensor 6906 positioned on a right femur of the skier, a sensor 6908 positioned on a left femur of the skier, a sensor 6910 positioned on a right tibia of the skier and a sensor 6912 positioned on a left tibia of the skier. In at least some embodiments, including but not limited to the illustrated embodiment, the sensors 6900 are capable of measuring: (1) three-axis acceleration via a three-axis accelerometer, (2) three-axis rotational velocity via a three-axis gyroscope, and (3) absolute heading via a 3-axis magnetometer. The sensors can also include GPS sensors. In some embodiments, the sensors 6900, alone or in combination, can determine inclination and roll of the skier and/or of the ski boots.

In at least some embodiments, the one or more sensors 6900 (e.g., sensors 6904, 6906, 6908, 6910, and/or 6912), may be positioned to capture orientation of the knee and hip joints. To that effect, each sensor 6900 may be positioned on the leg such that the difference between relative measurements can be used to calculate knee and hip position and motion. The tibia sensors may be positioned in the center-front of the tibia. The femur sensors may be positioned on the center top of the femur. The hip sensor or sensors may be positioned above the crotch and below the belly button where a belt-buckle might fall, central to the skier's hip.

In at least some embodiments, one or more portions of the activation circuit (e.g., activation circuit 195), such as the sensors, battery, and/or controller may be integrated into or otherwise mounted on clothing or other article(s) worn by a skier.

Figure 10:
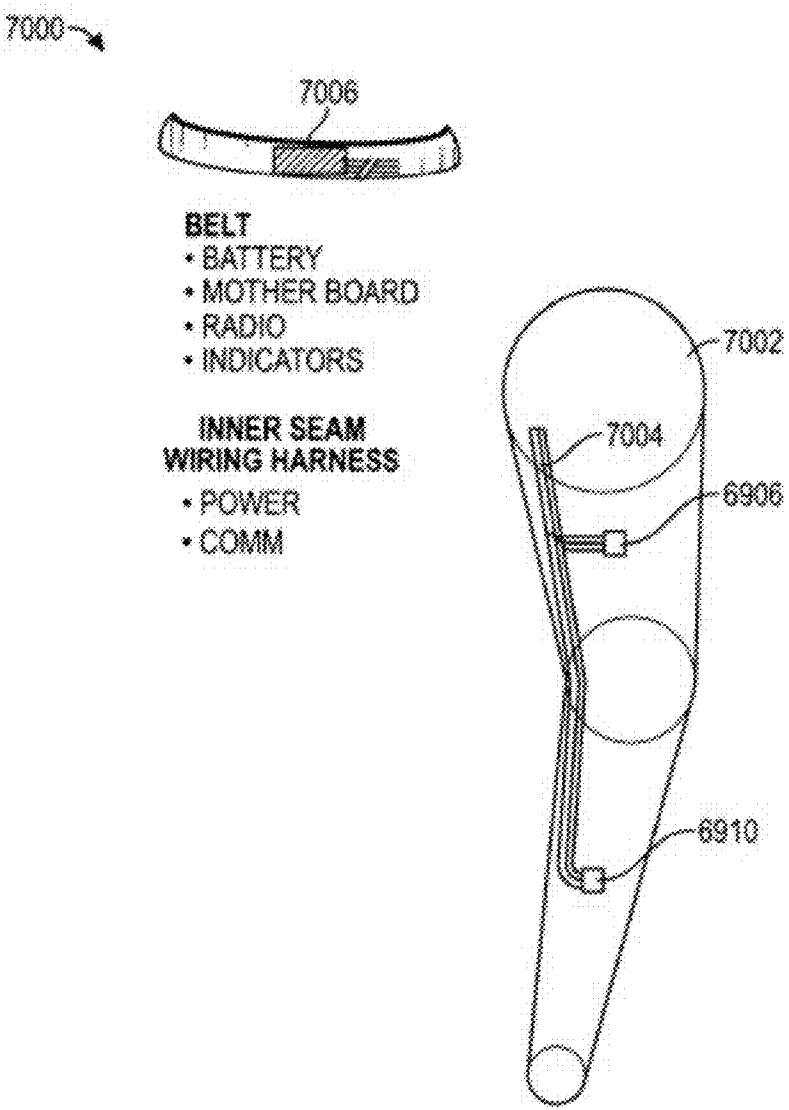
FIG. 10 is a schematic representation of clothing that may be worn by a skier and portions of the activation circuit that may be integrated into or otherwise mounted thereon, in accordance with at least some embodiments.

FIG. 10 is a schematic representation of clothing that may be worn by a skier, e.g., skier 6902, and portions of the activation circuit (e.g., activation circuit 195) that may be integrated into or otherwise mounted thereon, in accordance with at least some embodiments.

In accordance with at least some embodiments, the clothing that may be worn by a skier, e.g., skier 6902, may include a belt 7000 and a pair of leggings 7002 (thermal or otherwise) (only one leg is shown), which may be stitched into an inner lining of ski pants worn by the skier, or may be independently provided and worn as such.

Sensors to be positioned on the legs of the skier, e.g., sensors 6906-6912 (FIG. 8), may be integrated into or otherwise mounted on the leggings 7002.

A wiring harness (or wiring in any other form) 7004 may distribute power to, and communication signals to and/or from, some or all of the sensors positioned on the legs of the skier. In at least some embodiments, the wiring harness may be routed on an interior seam of the leg to help reduce potential damage from falls and general abuse. In at least some embodiments, the wiring may have the form of a power and communication bus, which may connect the sensors. In some embodiments, the power and/or communication bus may run the length of the leggings 7002.

One or more other portions 7006 of the activation circuit may be integrated into or otherwise mounted on the belt 7000. In at least some embodiments, these other portions 7006 may include: (1) a motherboard comprising a microprocessor (e.g., controller 180), (2) a radio for communication to a smartphone, smart watch, wearable wireless device, and/or a network-enabled device (via Bluetooth or otherwise), (3) a battery (e.g., battery 160), e.g., for powering the activation circuit or portions thereof, (4) battery-charging circuitry, (5) a waist sensor and/or (6) one or more visible network status indicators, integrated into or otherwise mounted on the belt 7000. In at least some embodiments, the motherboard itself includes the (2) radio for communication to: a smart phone, smart watch or similar wearable apparatus, and/or a network (Bluetooth or otherwise) enabled device, (3) battery, (4) battery charging circuitry, (5) waist sensor and/or (6) one or more visible network status indicators and is integrated into or otherwise mounted on the circuit board.

Data from the sensors, e.g., sensors 6900-6912 and/or sensor(s) 190, may be sampled (continuously or otherwise) by the microprocessor (e.g., controller 180).

In at least some embodiments, the processing may include a model of the skier. In at least some embodiments, this model is a physiological model is used to "observe" all sensors. In at least some embodiments, the sensor data is supplied to the model which may generate one or more signals in response at least thereto. Sensor data may be combined via a digital filter that incorporates the model to recursively update the current skier orientation, speed, and/or heading. Such data may be used to predict if a potential injury will occur. In at least some embodiments, the ski binding 100 safely releases prior to the injury.

In at least some embodiments, the microprocessor (e.g., controller 180) may be responsible for updating the skier model, determining the release decision (i.e., a decision as to whether to release the ski boot), recording performance data and/or communicating to an application on a user device and/or on a separate computer.

In at least some embodiments, the model of the skier may comprise a set of equations relating model inputs and sensor readings. The set of equations may be integrated using a variant of traditional Kalman filtering to output limb and body position, velocity, and muscle activity.

In at least some embodiments, the model of the skier is used within a feedback structure as an "observer" whereby the model is used to inform predictions of future body position, but incorrect predictions can update the model when necessary. In this way, the algorithm is able to predict danger of ACL damage and skier injury (or other unwanted results of an accident in these or other sports and activities).

In at least some embodiments, the activation circuit may include a self-check process that has the purpose of measuring and diagnosing the health of each critical component. In at least some embodiments, the result of the system check is readable via a ski-binding light with pre-programmed sequences (red, yellow, green, blinking red, for example) and/or via a smart phone application which may contain more detailed diagnostics (also may be implemented in any appropriate form factor such as on a smart watch). Each system check result may be tracked via personal profile linked to the binding to alert the skier of component damage of health degradation.

In at least some embodiments, the system check isolates key system features including: (1) binding release mechanism via a current and position monitor, (2) sensor response and calibration via a user sequence of actions and/or (3) software and firmware version control.

In at least some embodiments, if the system-check determines that the system is not suitable for the sport (e.g., skiing), the system does not allow the binding to close and the user is unable to use the binding or it's features. A log may be stored for individual diagnostic troubleshooting.

In at least some embodiments, a wired or wireless controller is installed on the ski binding, on a ski pole, or on the user's clothing to manually activate the explosive bolts and/or frangible nuts to the release the ski binding(s). In at least some embodiments, a system check is performed with each entry of the ski. In at least some embodiments, the user need not access their phone for usage. All controls can be ergonomic for a glove-wearing skier, and a wrist worn device such as a smart watch, sports wearable may be employed for the purpose.

There have been numerous studies investigating the proper DIN (Deutsches Institut fur Normung) number, a release force setting for ski bindings, for ski bindings across gender and age boundaries that typically consider number of false releases compared to number of ankle and knee injuries caused by a lack of release. In at least some embodiments, an extensive profile should enable data better correlated for physical conditions most relevant to likelihood of an ACL injury.

In at least some embodiments, the skier model is can be initially calibrated to the skier via an extensive physical evaluation. The model may include: (1) a questionnaire with traditional height, weight, skiing ability, gender, age, (2) a model using the sensors for limb length, form, and musculature, (3) a process to update the model based on skiing performance. For example, the forces and positions of the sensor array can be compared against the expectations from the model and updated accordingly and/or (4) a database keeping track of each model, skiing data, and an event log documenting releases and their conditions to better predict misses, false alarms, or hits. (Miss=did not release when it should have, False Alarm (FA)=a release when it should have not, Hit=a release when it should have).

In at least some embodiments, the ski model and data recording may be used by an individual or coach to gauge skier performance for safe and proper ski technique. In at least some embodiments, the system may include software (artificial intelligence software or otherwise) to label where poor or unsafe technique was measured. The software may record the data that would be necessary for visual replay. In at least some embodiments, akin to a race car driver re-driving a racetrack or course, the user will be able to replay their downhill run via a simulator or other similar device.

In at least some embodiments, the system may be used to augment skier performance in real time via auxiliary systems such as: (1) ski stiffeners, (2) muscle/limb enhancements, (3) ski shape deformation and/or (4) trajectory/terrain mapping.

In at least some embodiments, the ski binding system may be a suitable platform for integrating safety features that may be especially useful for off-trail skiing. These may include (1) location tracking, (2) avalanche detection, (3) emergency alert system and/or (4) audible and visual signals.

Figure 11:
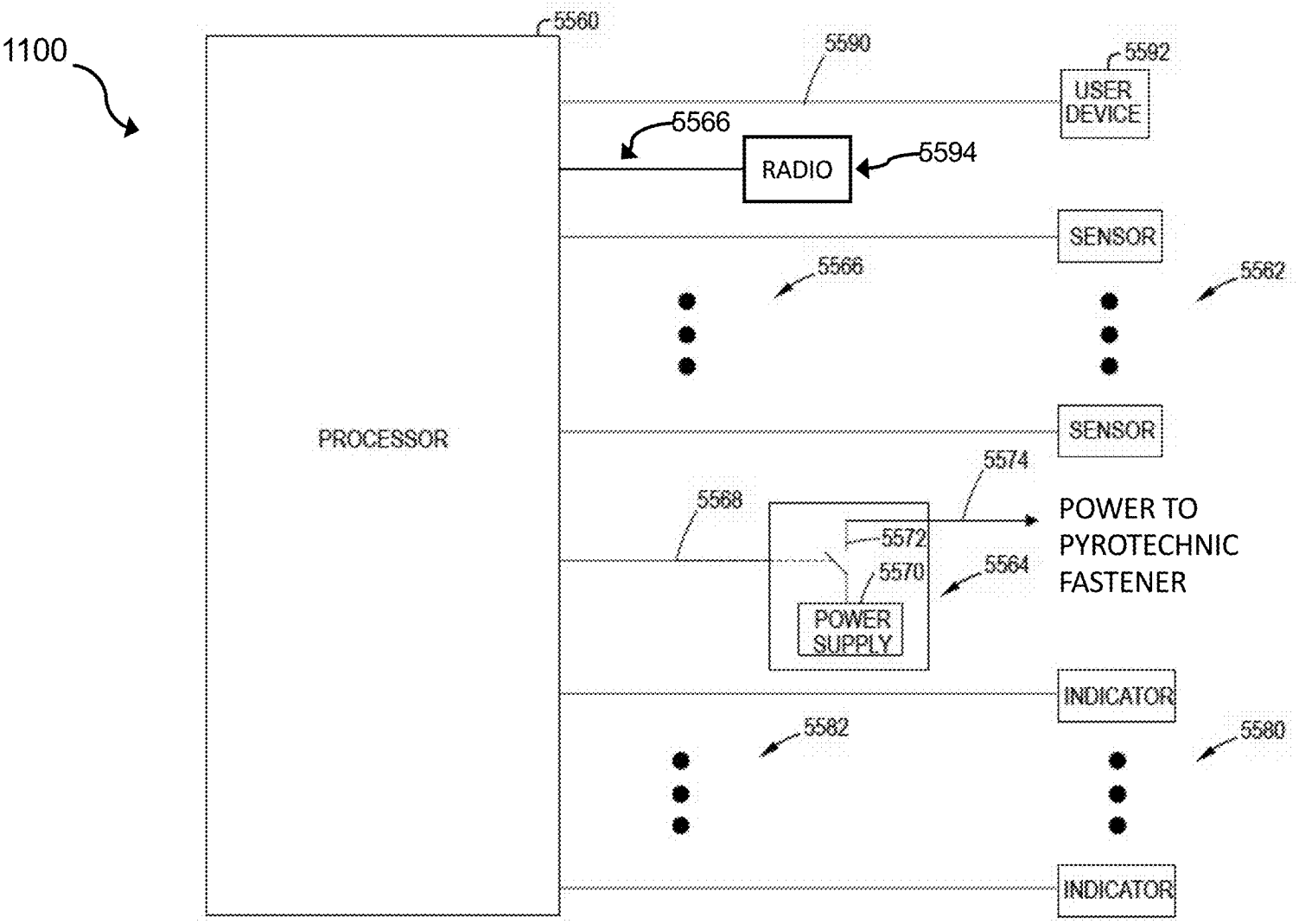
FIG. 11 is a schematic block diagram of one embodiment of an activation circuit.

FIG. 11 is a schematic block diagram of one embodiment of an activation circuit 1100. The activation circuit 1100 can be the same as the activation circuits described above, including activation circuit 195. Any of the pyrotechnic fasteners described herein (e.g., explosive bolts, frangible nuts) can be coupled to the activation circuit 1100, such as explosive bolt 132, explosive bolt 332A, explosive bolt 332B, explosive bolt 532, frangible nut 600, and/or explosive bolt 700. Thus, the activation circuit 1100 can be used to trigger the activation, detonation, and/or explosion of the explosive pyrotechnic fastener(s) to release a given ski boot/binding.

The activation circuit 1100 may include a processor circuit 5560, a plurality of sensors (sometimes referred to herein as a sensor system, such as sensor system 700) 5562, one or more power circuits 5564, and one or more radios 5594. The processor 5560 may comprise any type(s) of processor(s) or microprocessors. In some embodiments, the microprocessor-based controller 180 can comprise the processor 5560. Alternatively, the processor 5560 can comprise the controller 180. In a specific embodiment, the processor 5560 can comprise a microcontroller, such as an LPC5526 microcontroller available from NXP Semiconductors N.V. The plurality of sensors 5562 may comprise any type(s) of sensors, such as sensor(s) 190, 6900-6912. The one or more power circuits 5564 may comprise any type(s) of power circuit(s), including the electrical circuit 150, battery 160, and switch 170.

In at least some embodiments, the one or more power circuits 5564 may comprise one or more power supplies 5570 and one or more power switches 5572 (e.g., which can be same as switch 170). The one or more power supplies 5570 may comprise one or more batteries (rechargeable or otherwise), such as battery 160 (e.g., a 9V battery), and/or any other type of power source(s). The one or more power switch 5572 may comprise one or more power semiconductor devices and/or any other type(s) of power switch(es). In some embodiments, the power supply(ies) 5570 can include a voltage regulator (e.g., to regulate the output voltage of the power supply to a predetermined voltage such as 3V or 3.3V). When the power supply(ies) 5570 include a rechargeable battery, the power supply(ies) 5570 can include a battery charger (e.g., via a physical port such as a USB port) and/or a charge manager (e.g., which allows the activation circuit 1100 to operate during charging by disconnecting the battery).

The radio(s) 5594 can include a short-range and/or a long-range radio, such as a Bluetooth radio, a cellular radio, a WiFi radio, or other radio. The radio(s) 5594 can be used to communicate with the user device 5592. Additionally or alternatively, the radio(s) 5594 can be used to communicate with a corresponding radio on a second activation circuit to release a second ski boot/binding. For example, the radio(s) 5594 can be used to synchronize activation signals such that when one activation circuit 1100 generates an activation signal (e.g., to release the ski binding for the skier's left boot), the other activation circuit will also generate an activation signal (e.g., to release the ski binding for the skier's right boot).

Alternatively, the radio(s) 5594 can be used to confirm that both activation circuits have independently determined, based on sensor data from the sensors coupled to the respective activation circuits, that the skier has fallen (or is falling, such as in a falling state) in another state such that an activation signal should be generated to release the ski binding. This confirmation can be used to prevent unnecessary release of the ski bindings when the skier has not yet fallen. In another embodiment, the sensor data from each activation circuit can be shared between processors 5560 and/or with the user device 5592. In one example, the user device 5592 can determine, based on sensor data from sensors in each activation circuit (e.g., sensors for both boots/legs), whether to release the ski bindings, in which case the user device 5592 can send a user device signal or command to each processor 5560 in each activation circuit 1100 to release the corresponding ski binding.

The activation circuit 1100 may further include a plurality of signal lines or other communication links 5566 that couple the processor 5560 to the plurality of sensors 5562 and to the radio(s) 5594. In addition, the activation circuit 1100 may include one or more control lines or other communication links 5568 that couple the processor 5560 to the one or more power circuits 5564.

The activation circuit 1100 may further comprise one or more power line or other power link(s) 5574 from the one or more power circuit 5564 to the pyrotechnic fastener(s), such as explosive bolt 132, explosive bolt 332A, explosive bolt 332B, explosive bolt 532, frangible nut 600, explosive bolt 700, and/or frangible nut 800.

The activation circuit 1100 may further include a plurality of status indicators 5580 and a plurality of signal lines or other communication links 5582 that couple the processor 5560 to the plurality of status indicators 5580. The plurality of status indicators 5580 may indicate one or more status of the activation circuit 1100 and/or the pyrotechnic fastener(s) (e.g., of the igniter for the pyrotechnic fastener). The activation circuit 1100 may further include one or more communication links 5590 to one or more user devices 5592 and/or external components or networks. The user device 5592 may comprise a smartphone, a tablet, and/or any other type of computing device (mobile or otherwise). The communication links 5590 and/or the radio(s) 5594 can be used to send software or firmware updates from the user device 5592 to any portion of the activation circuit 1100.

In at least some embodiments, the user device(s) 5592 can comprise a computing device (e.g., smartphone, tablet, or otherwise) of a user that is using and/or will use ski bindings that include a pyrotechnic fastener.

In operation, in at least some embodiments, the processor 5560 receives one or more signals, from one or more of the plurality of sensors 5562 or otherwise, indicative of one or more conditions of the skier, and determines, based at least in part thereon, whether (and/or when) to trigger the activation (e.g., ignition, reaction, detonation, and/or explosion) of the pyrotechnic fastener to initiate release of the ski boot 110 from the ski binding 100. In at least some embodiments, if the processor 5560 determines to initiate release, the processor 5560 generates one or more control signals to initiate or trigger release, which may be supplied to the one or more power circuits 5564 via the one or more control lines or other communication link(s) 5568. The one or more power circuits 5564 receives the one or more control signals from the processor 5560 and in response at least thereto, closes the power switch 5572 to provide power to the pyrotechnic fastener via one or more of the one or more power line or other power link(s) 5574. The power provided to the pyrotechnic fastener activates (e.g., ignites, reacts, detonates, and/or explodes) the explosive material contained therein to release tension on the spring and release the ski boot from the ski binding.

In at least some embodiments, the one or more power supply 5570 may comprise one or more rechargeable batteries, such as a lithium ion battery, a lithium polymer battery, and/or a capacitor. The capacitor may in some embodiments comprise part of the laminate of the ski, e.g., ski 102. In some embodiments, the activation circuit 1100 may include piezoelectric transducers that harvest energy from vibrations of the ski, e.g., ski 120, during use and use such energy to recharge the battery and/or capacitor.

In at least some embodiments, the plurality of sensors 5562 may comprise one or more strain gauges, pressure transducers, gyroscopes, accelerometers, magnetometers, and/or other sensors (collectively, sensors). Such sensors can be attached to the ski 120, the ski boot 110, and/or the skier and/or other equipment or clothing worn by the skier. In some embodiments one or more sensors, e.g. pressure sensors, may be located inside the boot 110, such as between the plastic shell and the soft liner of the boot 110. In some embodiments, the sensors 5562 can be the same as sensors 6900. For example, the sensors 5562 can include a three-axis accelerometer (e.g., to measure three-axis acceleration), a three-axis gyroscope (e.g., to measure three-axis rotational velocity), and/or a 3-axis magnetometer (e.g., to measure absolute heading such as in a compass). The sensors 5562 can also include GPS sensors. In some embodiments, the sensors 5562, alone or in combination, can determine inclination and roll of the skier and/or of the ski boots. In some embodiments, the controller of the activation circuit can activate the explosive bolt(s) and/or frangible nut(s) when the GPS sensors indicate that the skier is passing or headed towards a predetermined boundary on the ski slope such as the edge of a ski trail, the edge of a race course (e.g., where netting may be located), trees, or another hazard. The boundary(ies) can be manually provided to the controller in advance of a race or they can be automatically provided by the ski area or ski racing organization.

In another embodiment, the boundary(ies) of the ski slope can be created by placing signal-generating devices at predetermined locations on the ski slope. For example, antennas can be placed along the boundaries or netting and the signal strength and/or signal triangulation can be used by the activation circuit controller, using sensors 5562 and/or radio(s) 5594, to determine when to activate the explosive bolt(s) and/or frangible nut(s). Alternatively, electrical wires can be placed on or under the snow along the boundaries. Current can pass through the electrical wires to generate electronic and magnetic fields. The electronic and/or magnetic field can be sensed by the sensors 5562 to activate the explosive bolt(s) and/or frangible nut(s) using the activation circuit controller.

In at least some embodiments, the processor 5560 may continuously receive signals from the plurality of sensors 5562 and determine, based at least in part on such signals, whether (and/or when) to initiate release of the boot 110 from the binding 100.

In at least some embodiments, any of the bindings 100 disclosed herein may include a control system having one or more portions that are the same as and/or similar to one or more portions of the activation circuit 1100 of the binding system 100.

In some embodiments, some or all of the activation circuit 1100 can be included in a system-on-a-chip and/or on a common circuit board.

Any of the activation circuits disclosed herein (e.g., activation circuit 195, 395, 495A, 495B, 595, 695, 795, 895, and/or 1100) can be activated manually or automatically. The skier can manually activate the explosive bolt(s) and/or frangible nuts by pressing a manual activation device (e.g., a button) that is electrically coupled (e.g., via a wired or wireless connection) to the controller of the respective activation circuit(s) to manually detonate the explosive bolt(s) and/or frangible nut(s). For example, pressing the manual activation device can generate a manual activation signal that is sent to the controller of the respective activation circuit(s), which causes the activation circuit controller (s) to activate the explosive bolt(s) and/or frangible nuts. In another embodiment, the explosive bolt(s) and/or frangible nuts can be manually activated by a third party (such as a person on the skier's team (e.g., coach, etc.) or a safety crew) using a wireless communication device (e.g., a smartphone, a tablet, a laptop, or another wireless device) that can wirelessly transmit the manual activation signal to the controller of the respective activation circuit(s), which causes the activation circuit controller(s) to activate the explosive bolt(s) and/or frangible nuts.

Figure 12:
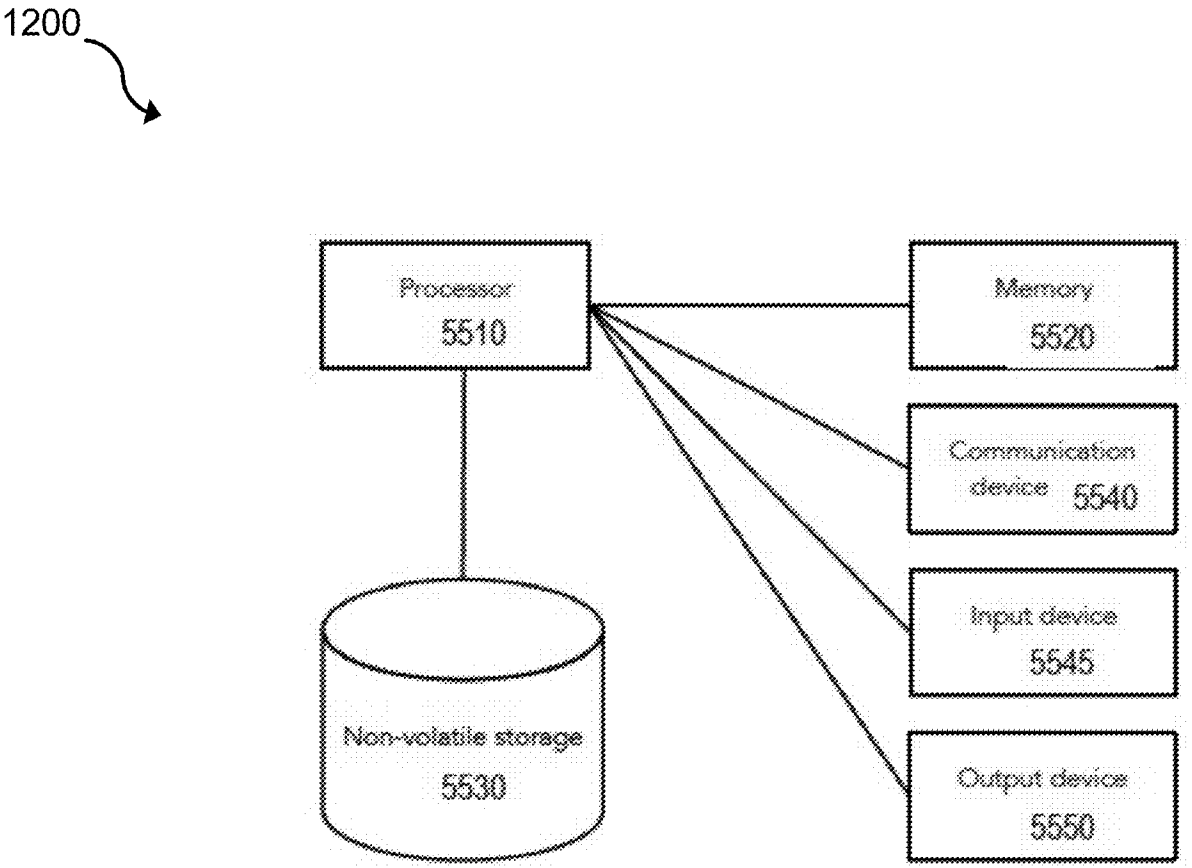
FIG. 12 is a block diagram of an architecture according to some embodiments.

FIG. 12 is a block diagram of an architecture 1200 according to some embodiments. In some embodiments, one or more of the systems (or portion(s) thereof), apparatus (or portion(s) thereof) and/or devices (or portion(s) thereof) disclosed herein may have an architecture that is the same as and/or similar to one or more portions of the architecture 1200.

In some embodiments, one or more of the methods (or portion(s) thereof) disclosed herein may be performed by a system, apparatus and/or device having an architecture that is the same as or similar to the architecture 1200 (or portion(s) thereof). The architecture may be implemented as a distributed architecture or a non-distributed architecture.

The architecture 1200 may include one or more processors 5510 and one or more non-transitory computer-readable storage media (e.g., memory 5520 and/or one or more non-volatile storage media 5530). The processor 5510 may control writing data to and reading data from the memory 5520 and the non-volatile storage device 5530 (e.g., non-transitory computer-readable medium) in any suitable manner. The storage media may store one or more programs and/or other information for operation of the architecture 1100. In at least some embodiments, the one or more programs include one or more instructions to be executed by the processor 5510 to perform one or more portions of one or more tasks and/or one or more portions of one or more methods disclosed herein. In some embodiments, the other information may include data for one or more portions of one or more tasks and/or one or more portions of one or more methods disclosed herein. To perform any of the functionality described herein, the processor 5510 may execute one or more processor-executable instructions stored in one or more non-transitory computer-readable storage media (e.g., the memory 5520 and/or one or more non-volatile storage media 5530).

In at least some embodiments, the architecture 1200 may include one or more communication devices 5540, which may be used to interconnect the architecture to one or more other devices and/or systems, such as, for example, one or more networks in any suitable form, including a local area network or a wide area network, such as an enterprise network, artificial intelligence network, machine learning network, an intelligent network, or the Internet. Such networks may be based on any suitable technology and may operate according to any suitable protocol and may include wireless networks or wired networks.

In at least some embodiments, the architecture 1200 may have one or more input devices 5545 and/or one or more output devices 5550. These devices can be used, among other things, to present a user interface. Examples of output devices that may be used to provide a user interface include printers or display screens for visual presentation of output and speakers or other sound generating devices for audible presentation of output. Examples of input devices that may be used for a user interface include keyboards, and pointing devices, such as mice, touch pads, and digitizing tablets. As another example, the architecture 1200 may receive input information through speech recognition or in other audible formats.

Figure 13:
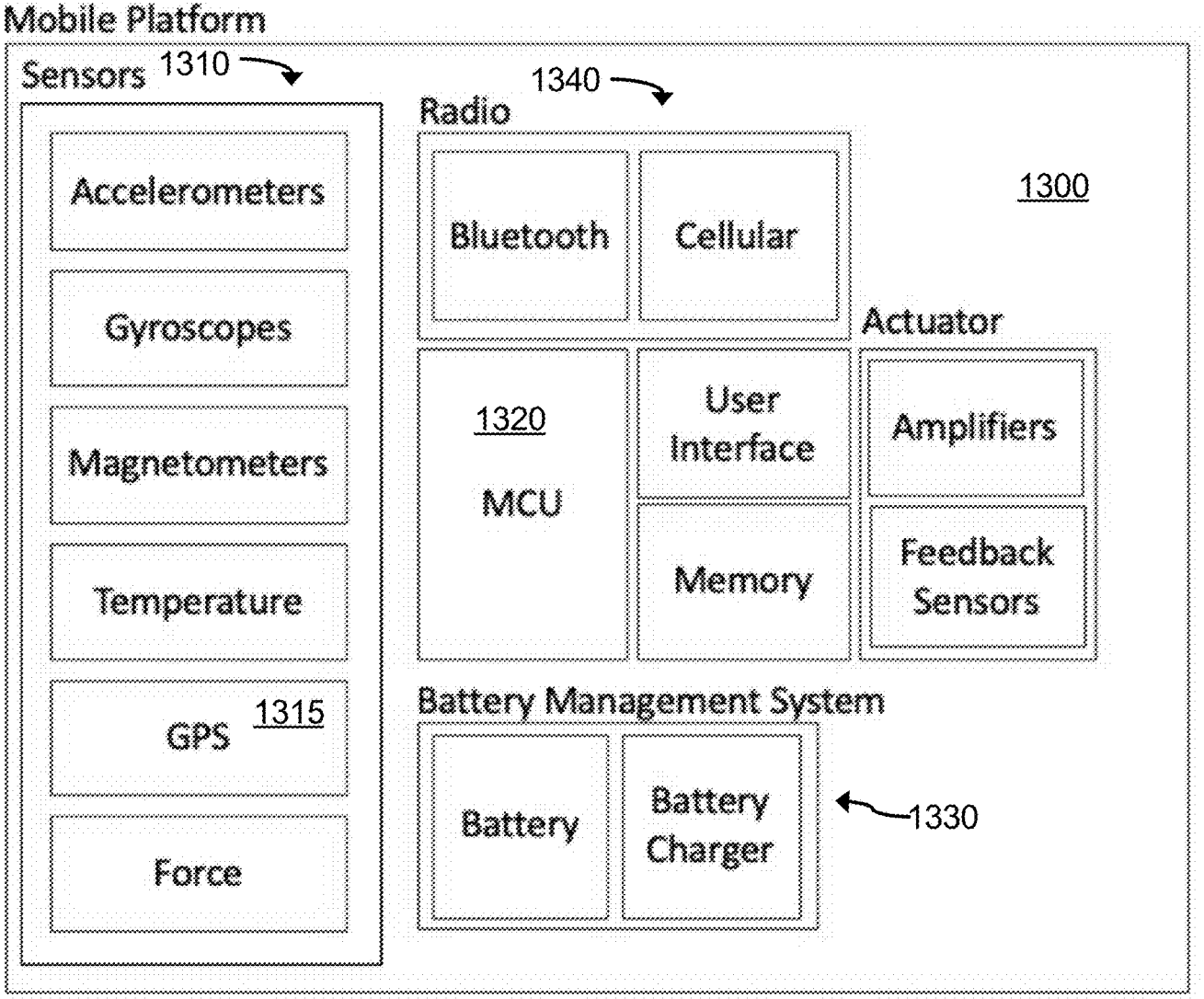
FIG. 13 illustrates an example of a mobile platform configured and arranged according to this disclosure.

FIG. 13 illustrates a mobile platform 1300 configured and arranged according to the present disclosure. The platform 1300 includes sensors 1310, processor circuits 1320, a power supply 1330, and wireless communications 1340. Optionally, the sensors 1310 include a GPS subunit 1315 and other electrical circuitry and components to achieve the above-described features. Sensors 1310 can be the same as or different than sensors 190. Processor circuit 1320 can be the same as or different than controller 180. In addition, power supply 1330 can be the same as or can comprise battery 160.

Figure 14:
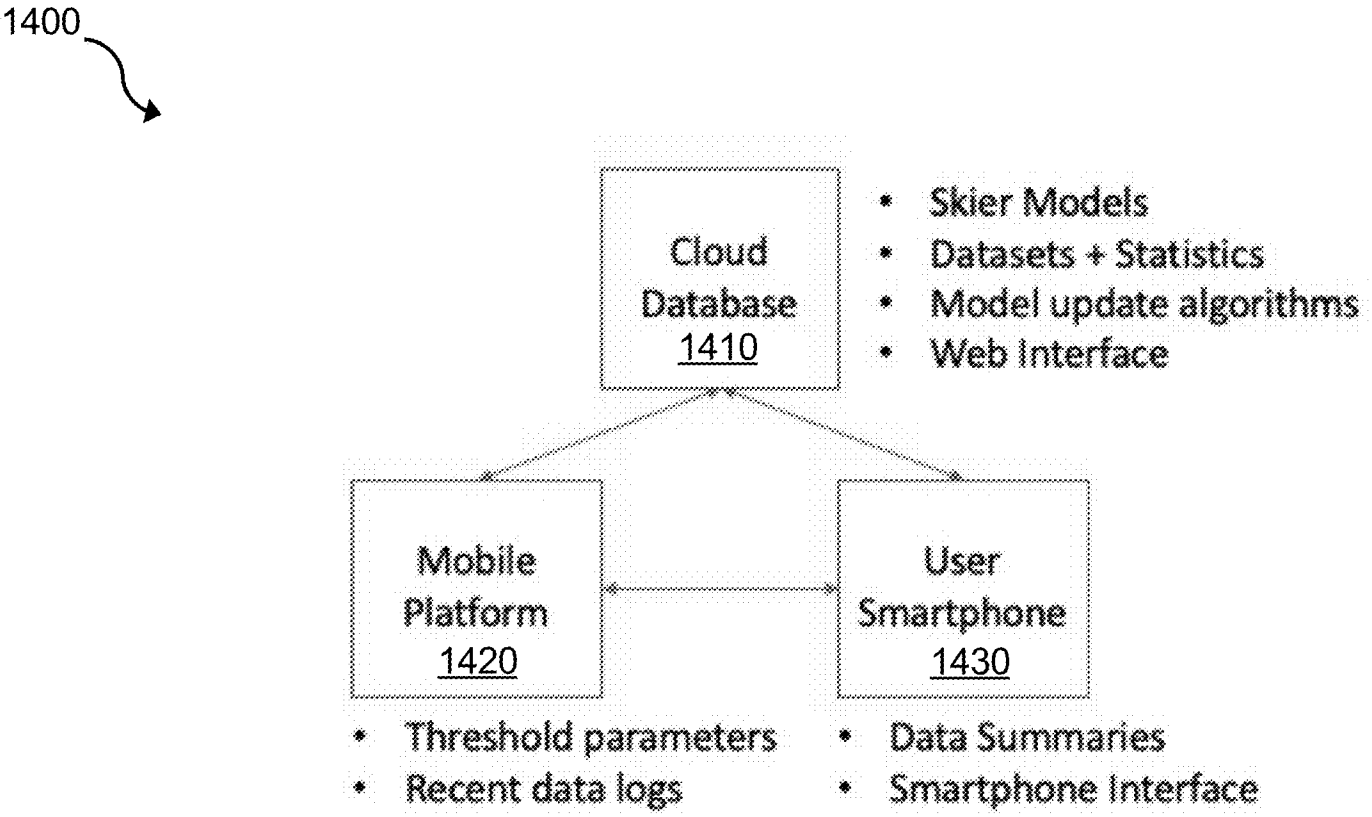
FIG. 14 illustrates a cloud-based or networked architecture that may be used to implement one or more aspects of this disclosure.

FIG. 14 illustrates a cloud-based or networked architecture 1400 for implementing the present system and method, including coupling of a network-accessible database or memory 1410 (e.g., a network-accessible server) and components to a mobile platform 1420, a user device 1430, or other electronic and data processing components. The network-accessible database or memory 1410 can store skier models, datasets, statistics, and model update algorithms, and can provide a web interface to these data. The mobile platform 1420 can store threshold parameters, such as the sensor settings for initiating release of the bindings, and recent data logs. The user device 1430 can store data summaries and provide an interface to the activation circuit.

Figure 15:
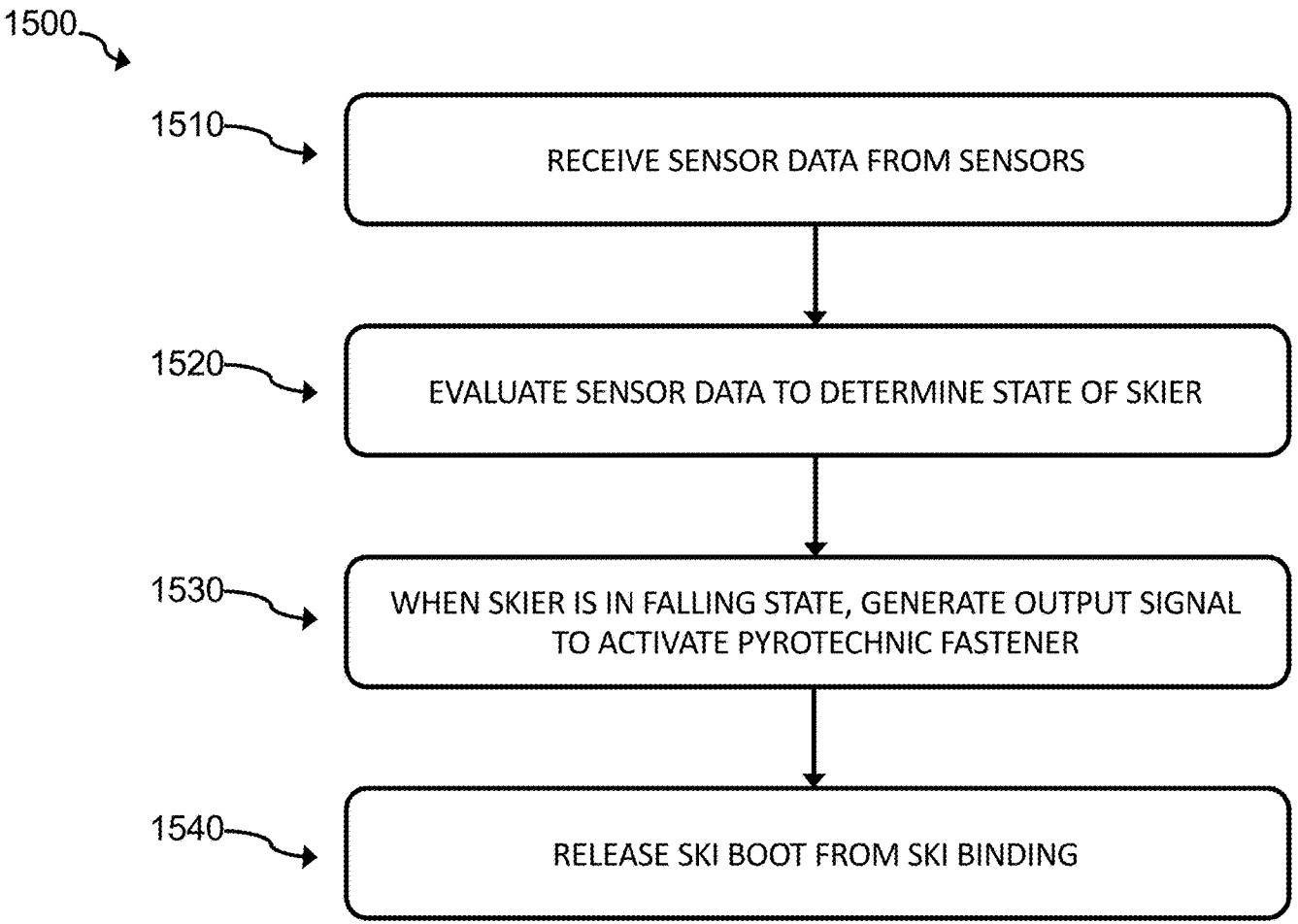
FIG. 15 is a flow chart of an automated method for releasing a ski binding according to one or more embodiments.

FIG. 15 is a flow chart 1500 of an automated method for releasing a ski binding having one or more pyrotechnic fasteners according to an embodiment. In step 1510, a microprocessor-based controller receives sensor data from one or more sensors disposed on a skier (e.g., on the skier's body and/or clothing) and/or on the skier's equipment (e.g., ski bindings, ski boots, skis, and/or poles). In step 1520, the controller evaluates the sensor data to determine the state of the skier. For example, the controller can compare the sensor data to a model of the skier. The controller can also evaluate the sensor data for a sudden change in orientation and/or acceleration which may indicate that the skier has fallen (e.g., is in falling state).

When the controller determines that the skier is in a falling state, in step 1530 the controller generates an output signal (e.g., a trigger signal) that activates (e.g., ignites, reacts, detonates, and/or explodes) explosive material in a pyrotechnic fastener in the ski binding. The pyrotechnic fastener can be an explosive bolt, a frangible nut, or another pyrotechnic fastener. The pyrotechnic fastener is used to releasably maintain a spring, in the ski binding, in a first state that secures a ski boot in the ski binding. The output signal causes a switch in an activation circuit to transition from a disconnected state to a connected state. In the disconnected state, the pyrotechnic fastener is electrically disconnected from the battery. In the connected state, the pyrotechnic fastener is electrically connected to the battery. Electrically energy from the battery, causes the explosive material to ignite and detonate, which at least partially breaks or destroys the pyrotechnic fastener, thereby transitioning the spring to a second state that releases (or at least partially releases) the ski boot from the ski binding in step 1540.

Figure 16:
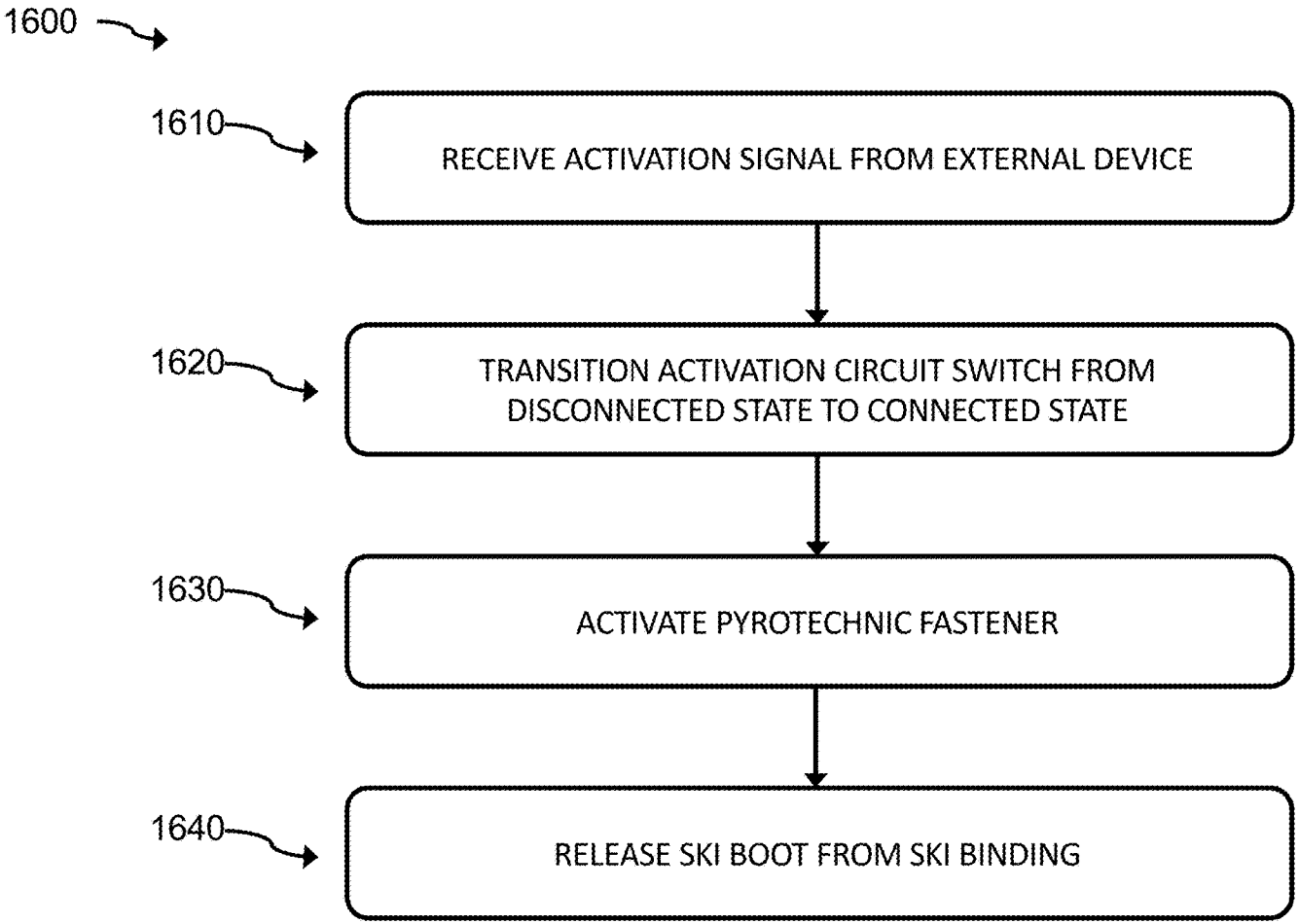
FIG. 16 is a flow chart of a method for releasing a ski binding having one or more pyrotechnic fasteners according to another embodiment.

FIG. 16 is a flow chart 1600 of a method for releasing a ski binding having one or more pyrotechnic fasteners according to another embodiment. In step 1610, a microprocessor-based controller receives a manual activation signal from an external device. The external device can include a manual-release device (e.g., a button or lever) that is accessible to the skier while he/she is skiing (e.g., on the skier's clothing or ski equipment (e.g., poles, helmet, goggles, etc.). The manual-release device is in electrical communication (e.g., using a wired and/or a wireless connection) with the controller of the activation circuit(s) for the pyrotechnic fastener(s) in the skier's ski bindings. Depressing the manual-release button/lever causes a manual activation signal to be sent, using a wired and/or a wireless connection, from the manual-release button/lever to the activation circuit controller(s). For example, the activation circuit controller(s) can be electrically coupled to a radio that can wirelessly receive the manual activation signal. Alternatively, one or more wires can electrically couple the manual-release button/lever and the activation circuit controller(s).

In another embodiment, the external device can include a manual-release button/lever or a computer (e.g., a smartphone, a tablet, a laptop, etc.) that is accessible to a person other than the skier, such as a member of the skier's race team or a member of the safety crew for the race course. The manual-release button/lever and/or computer is/are in electrical communication (e.g., using a wireless connection) with the controller of the activation circuit(s) for the pyrotechnic fastener in the skier's ski bindings. The computer can include a soft button or a hard button that generates the manual activation signal. The soft/hard button can function as a manual release device.

In step 1620, the controller of at least one activation circuit in the ski binding generates an output signal (e.g., a trigger signal) that causes the switch in the respective activation circuit to transition from the disconnected state to the connected state.

In step 1630, the respective pyrotechnic fastener is activated (e.g., ignited, reacted, detonated, and/or exploded) to release (or at least partially release) the skier's ski boot from the ski binding in step 1640. Additional details of the pyrotechnic fastener activation are described herein including in step 1530, above. The pyrotechnic fastener can be an explosive bolt, a frangible nut, or another pyrotechnic fastener.

Figure 17:
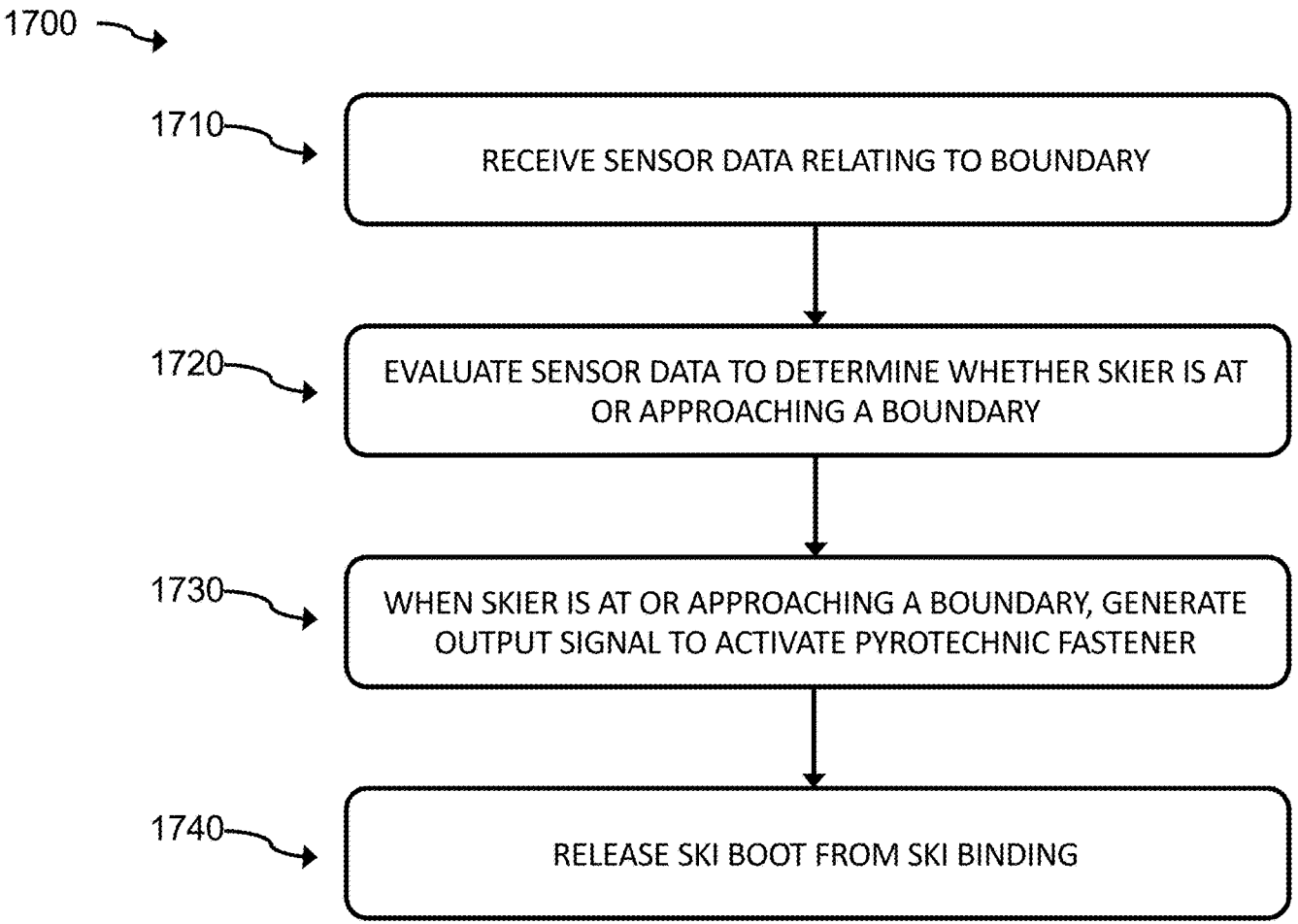
FIG. 17 is a flow chart of a method for releasing a ski binding having one or more pyrotechnic fasteners according to another embodiment.

FIG. 17 is a flow chart 1700 of a method for releasing a ski binding having one or more pyrotechnic fasteners according to another embodiment. In step 1710, a microprocessor-based controller receives sensor data from one or more sensors. That sensor data relates to a boundary of a ski slope or race course. The boundary can be the edge of the ski slope, such as where trees or a ski lift is located. Alternatively, the boundary can be the edge of a race course, such as where protective netting may be located.

For example, antennas can be placed along the boundaries and the signal strength and/or signal triangulation to determine when to activate the explosive bolt(s) and/or frangible nut(s). Alternatively, electrical wires can be placed on or under the snow along the boundaries. Current can pass through the electrical wires to generate electronic and magnetic fields. The electronic and/or magnetic field can be sensed by the sensors to activate the explosive bolt(s) and/or frangible nut(s) using the activation circuit controller. In another example, GPS sensors indicate that the position of location of the skier relative to one or more boundaries The boundary(ies) can be manually provided to the controller in advance of a race or they can be automatically provided by the ski area or ski racing organization.

In step 1720, the controller evaluates the sensor data to determine whether the skier is at or approaching a boundary. For example, the strength of the electromagnetic (e.g., radio) signal from the antennas or the strength of the electric or magnetic field from the electrical wires can be used to determine whether the skier is at or approaching the boundary. In another example, the controller can compare the current GPS coordinates with the boundary GPS coordinates to determine whether the skier is at or approaching a boundary. In some embodiments, the controller can determine a trajectory and/or speed of the skier using past GPS coordinates of the skier in addition to the current GPS coordinates.

In step 1730, when the controller determines that the skier is at or approaching a boundary, the controller generates an output signal (e.g., a trigger signal) that activates (e.g., ignites, reacts, detonates, and/or explodes) explosive material in a pyrotechnic fastener in the ski binding. The pyrotechnic fastener can be an explosive bolt, a frangible nut, or another pyrotechnic fastener. The pyrotechnic fastener is used to releasably maintain a spring, in the ski binding, in a first state that secures a ski boot in the ski binding. The output signal causes a switch in an activation circuit to transition from a disconnected state to a connected state. In the disconnected state, the pyrotechnic fastener is electrically disconnected from the battery. In the connected state, the pyrotechnic fastener is electrically connected to the battery. Electrically energy from the battery, causes the explosive material to ignite and detonate, which at least partially breaks or destroys the pyrotechnic fastener, thereby transitioning the spring to a second state that releases (or at least partially releases) the ski boot from the ski binding in step 1740.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. For example, those of ordinary skill in the art will readily envision a variety of other means and/or structures for performing the function and/or obtaining the results and/or one or more of the advantages described herein, and each of such variations and/or modifications is deemed to be within the scope of the embodiments described herein. In addition, though the embodiments has been described with respect to sports equipment for alpine skiing, it is recognized that aspects of the invention are also applicable to cross-country skiing, water skiing, snowboarding, wakeboarding, and/or other ski or board sports.

Those skilled in the art will appreciate the many equivalents to the specific embodiments described herein. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, kits, and/or methods described herein, if such features, systems, articles, materials, kits, and/or methods are not mutually inconsistent, is included within the scope of the present disclosure.

The above-described embodiments may be implemented in numerous ways. One or more aspects and embodiments of the present application involving the performance of processes or methods may utilize program instructions executable by a device (e.g., a computer, a processor, or other device) to perform, or control performance of, the processes or methods.

In this respect, various inventive concepts may be embodied as a non-transitory computer readable storage medium (or multiple non-transitory computer readable storage media) (e.g., a computer memory, one or more floppy discs, compact discs, optical discs, magnetic tapes, flash memories, circuit configurations in field programmable gate arrays or other semiconductor devices, or other tangible computer storage medium) encoded with one or more programs that, when executed on one or more computers or other processors, perform methods that implement one or more of the various embodiments described above.

The computer readable medium or media may be transportable, such that the program or programs stored thereon may be loaded onto one or more different computers or other processors to implement various one or more of the aspects described above. In some embodiments, computer readable media may be non-transitory media.

The terms "program" and "software" are used herein in a generic sense to refer to any type of computer code or set of computer-executable instructions that may be employed to program a computer or other processor to implement various aspects as described above. Additionally, it should be appreciated that, according to one aspect, one or more computer programs that when executed perform methods of the present application need not reside on a single computer or processor, but may be distributed in a modular fashion among a number of different computers or processors to implement various aspects of the present application.

Computer-executable instructions may be in many forms, such as program modules, executed by one or more computers or other devices. Generally, program modules include routines, programs, objects, components, data structures, etc. that performs particular tasks or implement particular abstract data types. The functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

What is claimed is:

1. An apparatus comprising:

a ski binding including a spring that has a first state that secures a ski boot in the ski binding and a second state that releases the ski boot from the ski binding;

an explosive bolt in mechanical communication with the spring to releasably maintain the spring in the first state;

a battery;

an activation circuit extending from the explosive bolt to the battery, the activation circuit including a switch having a connected state in which the battery and the explosive bolt are electrically connected through the switch and a disconnected state in which the battery and the explosive bolt are electrically disconnected; and a processor-based controller electrically coupled to the switch, the processor configured to automatically generate an output signal that transitions the switch from the disconnected state to the connected state to activate the explosive bolt in response to an input signal from one or more sensors, wherein activation of the explosive bolt causes the spring to transition from the first state to the second state to thereby release the ski boot from the ski binding.

2. The apparatus of claim 1, wherein:

the explosive bolt includes a hollow cylinder, and an explosive material is disposed in the hollow cylinder.

3. The apparatus of claim 2, wherein the explosive bolt includes a head and a threaded shaft, the hollow cylinder disposed between the head and the threaded shaft.

4. The apparatus of claim 3, wherein:

the explosive bolt includes an igniter, and a hole is defined in the head to receive the igniter.

5. The apparatus of claim 4, wherein the igniter is electrically coupled to the activation circuit.

6. The apparatus of claim 2, wherein the hollow cylinder includes a score to promote breakage of the hollow cylinder.

7. The apparatus of claim 1, wherein the spring is a heel DIN spring, a forward-pressure spring, or a toe DIN spring.

8. The apparatus of claim 1, wherein:

a frangible nut is mechanically coupled to the explosive bolt, the spring disposed between the frangible nut and the explosive bolt, and the frangible nut is electrically coupled to the activation circuit.

9. The apparatus of claim 1, further comprising a plurality of explosive bolts, wherein:

the ski binding includes a plurality of springs, each spring having the first state and the second state, and each explosive bolt is in mechanical communication with a respective spring to releasably secure the respective spring in the first state.

10. The apparatus of claim 9, wherein the activation circuit is electrically coupled to each explosive bolt.

11. The apparatus of claim 9, further comprising a plurality of activation circuits, each activation circuit electrically coupled to a respective explosive bolt.

12. The apparatus of claim 11, wherein the activation circuits are in electrical communication with each other.

13. The apparatus of claim 1, further comprising a tether attached to the explosive bolt and the ski binding.

14. The apparatus of claim 1, further comprising a bolt-retention housing disposed on the explosive bolt, the bolt-retention housing having a cavity to receive the explosive bolt when the explosive bolt is activated.

15. An automated method for releasing a ski boot from a ski binding, comprising:

receiving, by a processor-based controller, sensor data from a plurality of sensors disposed on a skier, on the ski boot, and/or on the ski binding;

in the processor-based controller, evaluating the sensor data to determine a state of the skier;

when the processor-based controller determines that the skier is in a falling state, automatically generating an output signal, with the processor-based controller, to activate a pyrotechnic fastener in the ski binding, the pyrotechnic fastener maintaining a spring, in the ski binding, in a first state that secures the ski boot in the ski binding;

generating an explosion with the pyrotechnic fastener, the explosion breaking at least a portion of the pyrotechnic fastener; and transitioning the spring from the first state to a second state that releases the ski boot from the ski binding.

16. The method of claim 15, wherein the pyrotechnic fastener comprises an explosive bolt.

17. The method of claim 16, wherein the explosive bolt is disposed in a heel piece of the ski binding.

18. The method of claim 15, wherein evaluating the sensor data comprises comparing the sensor data to a model of the skier.

19. The method of claim 15, wherein activating the pyrotechnic fastener comprises changing a state of a switch from a disconnected state to a connected state, the switch electrically coupling a battery to the explosive device in the connected state.

20. The method of claim 19, wherein when the switch is in the connected state, the switch electrically couples the battery to an igniter in the explosive device.

21. An automated method for releasing a ski boot from a ski binding, comprising:

receiving, by a processor-based controller, sensor data that corresponds to a position of a skier on a ski slope;

determining, by the processor-based controller, when the skier is at or approaching a boundary on the ski slope; and when the processor-based controller determines that the skier is at or approaching the boundary, automatically generating an output signal, with the processor-based controller, to activate a pyrotechnic fastener in the ski binding, the pyrotechnic fastener maintaining a spring, in the ski binding, in a first state that secures the ski boot in the ski binding;

generating an explosion with the pyrotechnic fastener, the explosion breaking at least a portion of the pyrotechnic fastener; and transitioning the spring from the first state to a second state that releases the ski boot from the ski binding.

22. The method of claim 21, wherein the sensor data comprises GPS data.

23. The method of claim 21, wherein the sensor data comprises electromagnetic signals.

24. An automated method for releasing a ski boot from a ski binding, comprising:

wirelessly receiving, by a processor-based controller, a manual activation signal from a manual release device;

automatically generating an output signal, with the processor-based controller in response to the manual activation signal, to activate a pyrotechnic fastener in the ski binding, the pyrotechnic fastener maintaining a spring, in the ski binding, in a first state that secures the ski boot in the ski binding;

generating an explosion with the pyrotechnic fastener, the explosion breaking at least a portion of the pyrotechnic fastener; and transitioning the spring from the first state to a second state that releases the ski boot from the ski binding.

25. The method of claim 24, wherein the manual release device comprises a button or lever disposed on the skier's clothing or ski equipment.

26. The method of claim 24, wherein the manual release device is operated by a person other than the skier.

* * * * *